US005507269A

United States Patent [19]

Morikawa

[11] Patent Number: 5,507,269

[45] Date of Patent: Apr. 16, 1996

[54] AIR FUEL RATIO CONTROL APPARATUS FOR INTERNAL COMBUSTION ENGINES

[75] Inventor: Junya Morikawa, Kasugai, Japan

[73] Assignee: Nippondenso Co., Ltd., Kariya, Japan

[21] Appl. No.: 501,320

[22] Filed: Jul. 12, 1995

[30] Foreign Application Priority Data

Aug. 4, 1994 [JP] Japan ..... 6-183692
Apr. 21, 1995 [JP] Japan ..... 7-097258

[51] Int. Cl.[6] ..... F02D 41/14

[52] U.S. Cl. ..... 123/684; 123/698

[58] Field of Search ..... 123/679–684, 123/698

[56] References Cited

U.S. PATENT DOCUMENTS 5,048,493 9/1991 Orzel et al. ..... 123/698
5,216,997 6/1993 Osanai et al. ..... 123/698

FOREIGN PATENT DOCUMENTS 312835 4/1989 European Pat. Off. .
61-129454 6/1986 Japan .
63-41632 2/1988 Japan .
5-288107 11/1993 Japan .

*Primary Examiner*—Andrew M. Dolinar
*Attorney, Agent, or Firm*—Cushman, Darby & Cushman

[57] ABSTRACT

In a fuel vapor purge mechanism, the fuel vapor generated from a fuel tank and stored in a canister undergoes flow volume control with a purge solenoid valve while being introduced to an intake system of the engine via a purge passageway. Meanwhile, in an air/fuel ratio feedback control system, by means of a linear air/fuel ratio sensor mounted on an exhaust system of the engine, the air/fuel ratio of air-fuel mixture of fuel and intake air including the fuel vapor. If a change amount of a purge ratio the fuel vapor goes above a determined value, there is compensation of the air/fuel ratio compensation coefficient FAF concerned with the feedback control based on the change ratio.

6 Claims, 14 Drawing Sheets

FIG.8A
FIG.8B
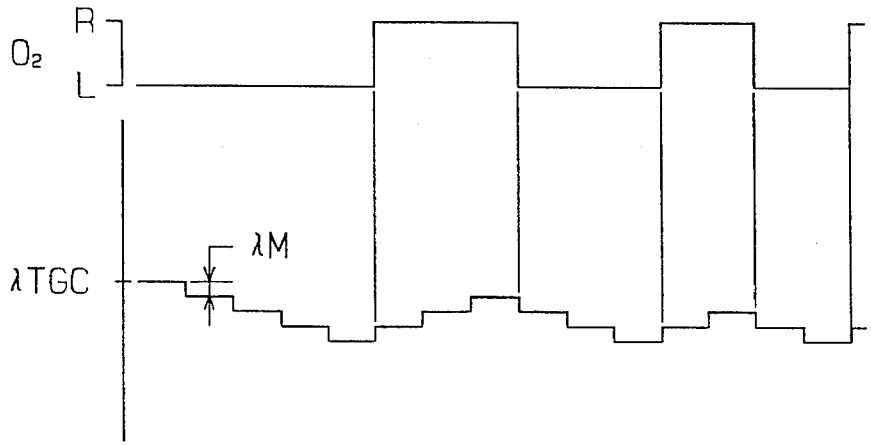
FIG.9A
FIG.9B
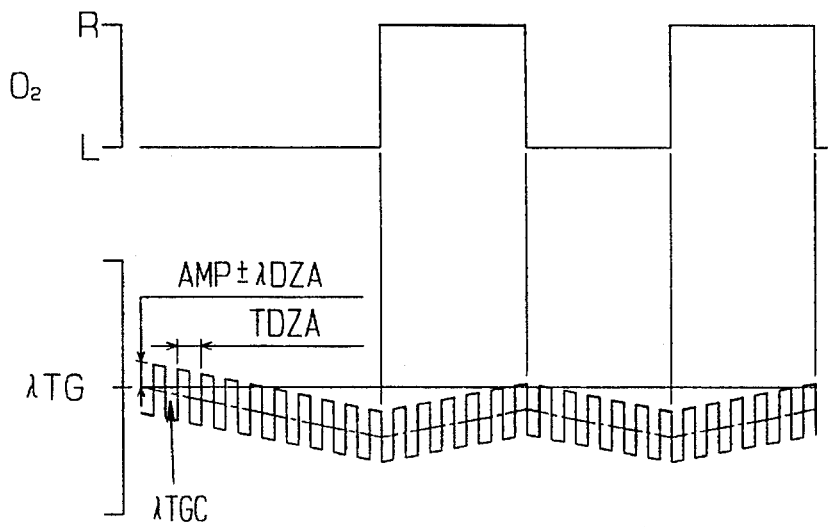

FIG.12

FULL OPEN PURGE RATIO (%)

| Ne (rpm) \ PM (mmHg) | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

AIR FUEL RATIO CONTROL APPARATUS FOR INTERNAL COMBUSTION ENGINES

CROSS REFERENCE TO RELATED APPLICATIONS

This application is based on and claims priorities of Japanese Patent Applications No. 6-183692 filed Aug. 4, 1994 and No. 7-97258 filed on Apr. 21, 1995, the content of which is incorporated herein by reference.

BACKGROUND OF THE INVENTION

1. Field of the Invention

The present invention concerns an air/fuel ratio control apparatus for an internal combustion engine, which is located in the internal combustion engine possessing a discharge prevention mechanism for fuel vapors, and appropriately controls the air/fuel ratio of the air-fuel mixture. In particular, it concerns realization of the appropriate control mechanism structure, adopting a system in which a linear air/fuel ratio sensor is employed to carry out feedback control of the air/fuel ratio.

2. Description of Related Art

As is known, a discharge prevention mechanism for fuel vapor involves a mechanism for storage in a canister of fuel vapor generated from a fuel tank, and passage of the stored fuel vapor through a purge passage for discharge to an air intake system of an internal combustion engine in order to prevent the fuel vapor from being discharged to the exterior.

Moreover, regarding discharge of the fuel vapors to the engine air intake system, it is well known that there is usually passage through a flow volume control valve known as a purge valve disposed in a purge passageway in order to control the fuel vapor flow volume in the passageway, that is, the purge flow volume.

However, although the purge flow volume is generally adjusted as a volume in proportion to the engine air intake volume, because the flow volume is adjusted and controlled separately from normal fuel injection control, during the period that purge is taking place, discrepancies can readily occur in the air/fuel ratio that has been set according to the running conditions of the engine.

Conventionally, there has been proposal of an air/fuel ratio control apparatus such as disclosed in Japanese Non-Examined Patent Publication No. Sho 63-41632 in order to deal with such discrepancies in the air/fuel ratio.

In other words, with the device described in the above patent publication, a prerequisite is a system for feedback control of the air/fuel ratio based on an output of an air/fuel ratio sensor (oxygen density sensor: $O_2$ sensor) installed in an engine exhaust system.

Purge control can be roughly divided into three main steps:

(1) learning a deviation of a feedback value (air/fuel ratio compensation coefficient FAF) based on whether there is purge or not;

(2) computation of a fuel compensation amount according to the purge based on the learning value and purge flow volume; and (3) compensation of a basic fuel injection volume based on the fuel compensation amount that is computed.

Carrying out such purge control prevents the discrepancies in the air/fuel ratio resulting from purge.

In order to maintain such purge controllability in all engine operational ranges, there is naturally a need for controllability with a high level of accuracy regarding the purge flow volume.

Actually, however, due to such factors as insufficient linearity of the flow characteristics of the purge valve itself as well as tolerance and computation deviations for the purge flow volume, there is considerable scattering of the learning value for deviation in the feedback value (air/fuel ratio compensation coefficient FAF) based on whether there is the purge or not, as well as the purge fuel compensation amount based on this.

It can also be understood here that, because the purge flow volume is determined by the pressure difference before and after the purge valve and by the valve aperture, accurate computation with an actual vehicle is difficult.

Also, in order to obtain high controllability regarding the purge flow volume, there is naturally a need in the purge valve for an expensive control valve and extensive control logic, thus leading to a major increase in production costs.

On the other hand, although the conventional apparatus features feedback control of the air/fuel ratio based on the output from the air/fuel ratio sensor, it presupposes use of the $O_2$ sensor as the air/fuel ratio sensor. In cases employing a linear air/fuel ratio sensor of the type that has been frequently used in recent years, the following further problems result.

Regarding a linear air/fuel ratio sensor that detects linearly the air/fuel ratio of the air-fuel mixture from the oxygen density in the exhaust gas, the feedback response is very high compared with the $O_2$ sensor, so that it has become possible to also accurately detect deviations in the air/fuel ratio even in short cycles that could not be detected with feedback from the $O_2$ sensor. As a result, even in learning the feedback value (air/fuel ratio compensation coefficient FAF) depending on whether there is purge or not, it is not possible to distinguish whether:

it is a fluctuation in the feedback value (air/fuel ratio compensation coefficient FAF) based on purge; or it is a fluctuation in the feedback value (air/fuel ratio compensation coefficient FAF) based on transient running, gear shift changing and other factors.

As a result, the reliability of the learning value itself is negatively effected.

If the reliability of the learning value decreases with the conventional apparatus, there is also a negative effect on controllability concerning the air/fuel ratio, which in turn can bring about worsening of emissions and a reduction in drivability.

SUMMARY OF THE INVENTION

The present invention has an objective to provide an air/fuel ratio feedback control system employing a linear air/fuel ratio sensor in order to provide a superior air/fuel ratio control apparatus for internal combustion engines. The present invention has a further objective to prevent worsening of air/fuel ratio control resulting from scattering of the purge flow volume control without requiring an expensive control valve, etc. as a purge valve.

According to the present invention, fuel vapors stored in a canister after emission in a fuel tank undergo control of flow volume by means of a flow volume control valve (purge valve), after which they travel through a purge passageway for introduction to an air intake system of an internal combustion engine. However, although the flow volume of the fuel vapor (i.e., the purge flow volume) is controlled according to the air intake volume of the engine, there is regulation and control of the flow volume separate from normal fuel injection control via a fuel injection valve. As a result, even though a control means accomplishes feedback control according to an output from the air/fuel ratio sensor, during the period that purge is carried out, discrepancies occur in the air/fuel ratio, and such discrepancies cannot be ignored.

Thus, a compensation means is employed in order to compensate the compensation coefficient for the feedback control according to the amount of change in the ratio of the fuel vapor flow volume (purge flow volume) relative to the engine air intake volume. In this way, if there is compensation of the compensation coefficient in response to the amount of change in the purge flow volume ratio (i.e., purge ratio) relative to the engine air intake volume, compared with cases where the purge flow volume itself is monitored, it becomes easier to absorb errors in the purge valve itself and errors in computation of the purge flow volume. As a result, there is no longer a need for an expensive control valve and extensive control logic for the purge valve, thus making it possible to obtain the appropriate air/fuel ratio as desired.

Moreover, because there is compensation of the compensation coefficient with the amount of change in the purge ratio as the target of monitoring, even if the air/fuel ratio sensor is a linear air/fuel ratio sensor with fast feedback response, it is possible to accurately determine fluctuations in the compensation coefficient due to purge and to carry out compensation. Moreover, by employing the linear air/fuel ratio sensor, it is possible to increase the control accuracy regarding air/fuel ratio feedback control.

Preferably, if the following are incorporated in the correction means, there is restriction of execution of unnecessary compensation by the compensation means in a state with minimum change in purge ratio, that is, a state in which the feedback control system is relatively stable although purge is taking place:

Compensation of the compensation coefficient when the change amount of the fuel vapor flow volume ratio (purge ratio) exceeds a set value; or Compensation of the compensation coefficient when the change rate of the compensation coefficient due to change in the fuel vapor flow volume ratio (purge ratio) exceeds a set value.

In other words, there is an increase in the convergence and stability of the feedback control system.

Also, if the value of the previous compensation of the ratio of the fuel vapor flow volume is PGRi−1, the present value of the ratio of the fuel vapor flow volume is PGRi; and if the previous value of the change volume of the compensation coefficient due to the change in the fuel vapor flow volume ratio of the fuel vapor flow volume is deltaFAFi−1 (ΔFAFi−1), there is derivation of the present compensation value deltaFAFi (ΔFAFi) regarding the correction coefficient with the following equation:

$$\text{delta}FAFi=(PGRi/PGRi-1)\ \text{delta}FAFi-1.$$

With such a structure of the correction means, there is almost complete mutual cancellation of the error of the purge valve itself and errors in calculation of the purge flow volume, etc., thus making it possible to obtain compensation accuracy regarding the compensation coefficient.

Furthermore, according to the definitions of the various values, in the case of the compensation means to compensate the compensation coefficient when the change amount of the ratio of the fuel vapor flow volume (purge ratio) exceeds a set value, there is execution of compensation according to the following conditions:

$$|PGRi-1-PGRi| \geqq \text{set value}.$$

In the case of the compensation means to compensate the compensation coefficient when the change amount of the ratio of the fuel vapor flow volume (purge ratio) exceeds a set value, there is execution of compensation according to the following conditions:

$$|\text{delta}FAFi-1-\text{delta}FAFi| \geqq \text{set value}.$$

Moreover, if the compensation means is further composed as follows, it is possible to further increase the convergence and stability as the feedback control system:

Compensation of the compensation coefficient at a value in which the computed compensation value deltaFAFi is appropriately averaged.

Furthermore, if the value of the previous compensation of the compensation coefficient becomes FAFi−1, the present value FAF of the compensation coefficient is derived by the following equation:

$$FAF=FAFi-1-(\text{delta}FAFi-1-\text{delta}FAFi)/2.$$

If the compensation means is structured described above, the present compensation value deltaFAFi computed from the above equation is averaged or smoothed as "(deltaFAFi−1−deltaFAFi)/2", thus obtaining the ideal convergence and stability for the feedback control system.

BRIEF DESCRIPTION OF THE DRAWINGS

In the accompanying drawings:

FIGS. 8A and 8B are time charts showing, respectively, the oxygen sensor output and the setting state for the target air/fuel ratio central value carried out when setting the target air/fuel ratio following activation of the three-way catalyst;

FIGS. 9A and 9B are time charts showing, respectively, the oxygen sensor output and the setting state of the target air/fuel ratio carried out following activation of the three-way catalyst of the embodiment;

FIG. 12 is a data table of a memory map of the full purge ratio used in purge ratio control;

DETAILED DESCRIPTION OF THE PREFERRED EMBODIMENT

Figure 1:
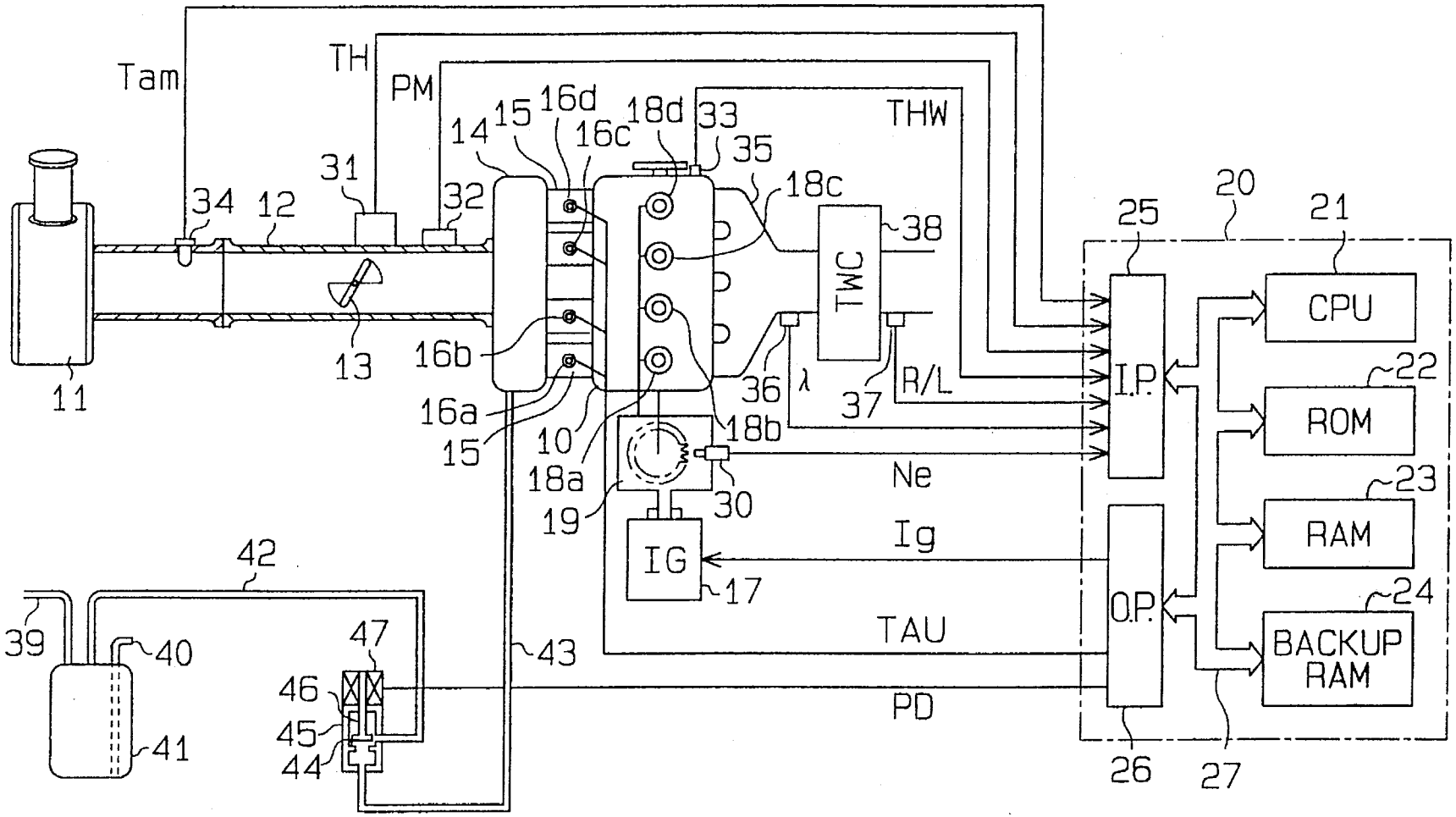
FIG. 1 is a block diagram showing one embodiment regarding an air/fuel ratio control apparatus for an internal combustion engine according to the present invention.

First, as shown in FIG. 1, an engine 10 is a 4-cylinder 4-cycle spark ignition type engine whose intake air is taken into cylinders via an air cleaner 11, an intake pipe 12, a throttle valve 13, a surge tank 14 and intake branch pipes 15.

Meanwhile, the system is so composed that the fuel is force fed from a fuel tank not shown in the figure, and there is fuel injection supply from fuel injection valves 16*a*, 16*b*, 16*c* and 16*d* disposed on the intake branch pipes 15.

Also disposed on the engine 10 is a distributor 19 for distributing the high-voltage electrical signals supplied by an ignition circuit (IG) 17 to the spark plugs 18*a*, 18*b*, 18*c* and 18*d* of the cylinders. Also disposed inside the distributor 19 is a rotational speed sensor 30 to detect the rotational speed Ne of the engine 10. The rotational speed sensor 30 is attached opposite to a signal rotor secured to the cam axle which revolves one time for every two revolutions of a crankshaft of the engine 10. It outputs 24 pulse signals proportionally to the rotational speed Ne in two rotations of the engine, that is in 720° CA.

Disposed near the throttle valve 13 is a throttle sensor 31 to detect the opening angle TH of the throttle valve 13. The throttle sensor 31 outputs analog signals in response to the throttle opening TH and ON/OFF signals from an idle switch detecting that the throttle valve 13 is almost closed.

In addition, the engine 10 comprises an intake air pressure sensor 32 to detect intake air pressure PM at downstream of the throttle valve 13, a warming-up sensor 33 to detect the cooling water temperature THW of the engine 10, an intake air temperature sensor 34 to detect the intake air temperature Tam, etc.

An exhaust pipe 35 of the engine 10 includes a three-way catalyst (TWC) 38 to reduce the harmful substances (NOx, HC, CO) in the exhaust gas emitted from the engine 10. Located upstream of the three-way catalyst 38 is an air/fuel ratio sensor (linear air/fuel ratio sensor) 36 to detect the linear detection signals in response to the relative air/fuel ratio λ (hereinafter denoted as lambda) of the air-fuel mixture supplied to the engine 10 (air/fuel ratio when the theoretical or stoichiometric air/fuel ratio is defined as follows: lambda=λo (lambda o)=1). Located downstream of the three-way catalyst 38 is an oxygen density sensor ($O_2$ sensor) that outputs detection signals according to whether the air/fuel ratio lambda of the air-fuel mixture supplied to the engine 10 is rich or lean (R/L) relative to the theoretical air/fuel ratio lambda o.

On the other hand, the following purge mechanism is formed on the engine 10 in a way that it includes purge pipes (purge passageways) 39, 42 and 43 communicating between a fuel tank not shown in the figure and the surge tank 14.

Located between the purge pipe 39 and the purge pipe 42 is a canister 41 housing activated charcoal therein to act as an adsorbent to adsorb the fuel vapor generated from the fuel tank. Disposed on the canister 41 is an air opening 40 to introduce outside air.

Also, located between purge pipe 42 and purge pipe 43 is variable flow volume solenoid valve 45 (hereinafter referred to as a purge solenoid valve). The purge solenoid valve 45 is usually set in a direction that a valve body 46 closes a seat 44 by means of a spring not shown in the figure (valve opening direction). By excitation or energization of a coil 47 the valve body 46 is pulled upward as shown in the figure so that it opens the seat 44 (valve opening). In other words, the purge pipe 43 communicating with the surge tank 14 closes due to deenergization of the coil 47 of the purge solenoid valve 45 and opens due to excitation of the coil 47. The purge solenoid valve 45 is driven by duty ratio control based on pulse width modulation. Due to the drive signal PD provided from the electronic control device 20, the opening adjustment may be performed continuously from fully closed to fully open.

Incidentally, if, in response to the purge solenoid valve 45, the drive signal PD is supplied from the electronic control device 20 so that the canister 41 communicates with the surge tank 14 of the engine 10:

(1) new air Qa is introduced from the outside via the air opening 40; and (2) the canister 41 is ventilated by outside new air Qa via the air opening 40 so that the fuel vapors adsorbed are sent from the surge tank 14 of the engine 10 to the cylinders.

In this manner, execution of so-called canister purge is made, which also makes it possible to recover the adsorption function of the canister 41. The introduction volume Qp (liters/min) of the new air Qa is regulated by changing the duty of the drive signal (pulse signal) PD supplied from the electronic control device 20 to the purge solenoid valve 45.

Figure 2:
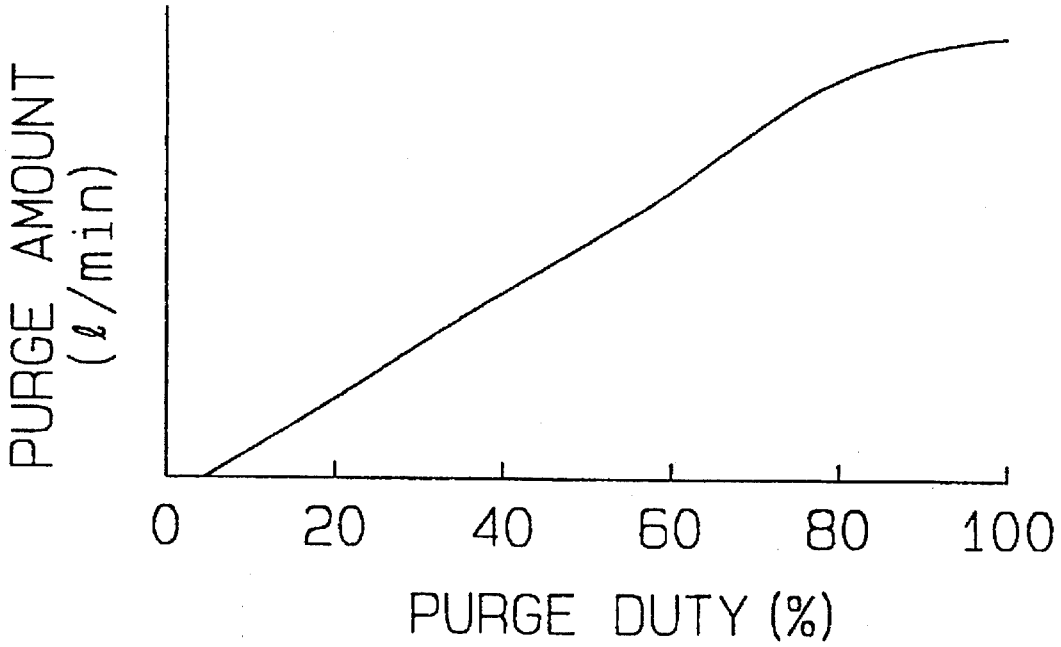
FIG. 2 is a graph showing the characteristics of the purge solenoid shown in FIG. 1.

FIG. 2 is the purge amount characteristic diagram which shows the relationship between the duty of the drive signal (pulse signal) PD supplied to the purge solenoid valve 45 and the purge amount in a case where the negative pressure inside the intake air pipe is constant. As is shown in FIG. 2, as the duty of the drive signal (pulse signal) PD is increased from 0%, the purge amount, that is purge air amount sucked into the engine 10 via canister 41 (i.e., fuel vapor amount) sucked into the engine 10 via the canister 41) increases in almost direct proportion.

Meanwhile, the electronic control device 20 included with an input port 25 inputting signals from the sensors and an output port 26 outputting control signals to the actuators. It further includes a microcomputer comprising a CPU 21, a ROM 22, a RAM 23, a backup RAM 24, etc. connected to port 25 and port 26 via a bus 27.

At the electronic control device 20, there is input via the input port 25 of the various sensor signals mentioned above such as the rotational speed Ne, the throttle opening angle TH, the intake air pressure PM, the cooling water temperature THW, the intake air temperature Tam, the air/fuel ratio lambda and the oxygen density (rich/lean output) R/L. In addition, there are various computations carried out according to the sensor signals. Then, via the output port 26, there is output of various signals starting with the solenoid valve 45 drive signal PD, and including the drive signals (operational signals based on the fuel injection volume) TAU of the fuel injection valves 16*a* to 16*d* as well as the control signal (ignition timing signal) Ig of the ignition circuit 17.

Figure 3:
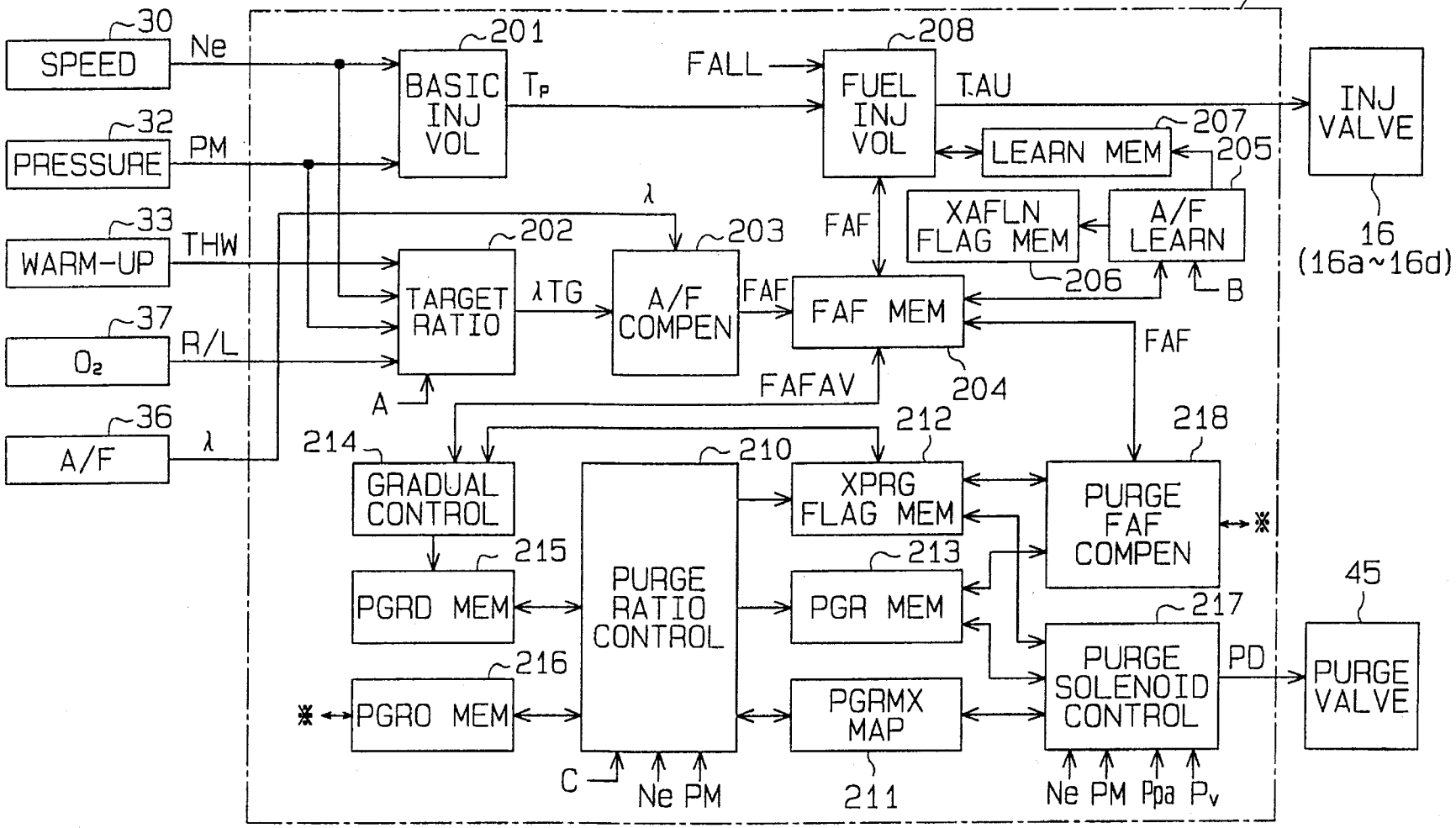
FIG. 3 is a block diagram showing the functional structure regarding mainly the air/fuel ratio control system of the electronic control apparatus in the embodiment.

FIG. 3 shows the functional structure concerning mainly the sections of the electronic control device 20 related to air/fuel ratio control and purge control. FIGS. 4 to 16A–16C show the processes and processing sequences when the control device 20 carries out controls.

More detailed description of the functions of the electronic control device 20 and of its operations of the embodiment are described with reference to FIG. 3 and FIGS. 4 to 16.

There is a description of the basic functions of the electronic control device 20 as shown in FIG. 3.

Regarding the electronic control device 20 shown in FIG. 3, a basic injection volume computation section 201 is a section for computing the basic fuel injection volume Tp for the engine 10 based on the rotational speed Ne and the intake air pressure PM among the sensor signals that are received by the unit. Regarding the computation, for example, of the value of the basic fuel injection volume Tp matching the operational ranges as determined according to the values of the applicable rotational speed Ne and the intake air pressure PM, it is possible to use a map that is stored beforehand in the memory.

Also, regarding the electronic control device 20, the target air/fuel ratio setting section 202 is the section used to set the target air/fuel ratio λTG (lambda TG) based on the output TWH from the warming up sensor 33 or based on the output R/L from the $O_2$ sensor 37 under the condition (condition A) that the air/fuel ratio feedback conditions are satisfied.

Also, it is assumed that, as the air/fuel ratio feedback conditions as the condition A, the followings are satisfied:

(A1) there are no fuel increase compensations;

(A2) it is not during a fuel cut;

(A3) it is not during high load running; and (A4) the air/fuel ratio sensor 36 is activated.

The air/fuel ratio compensation coefficient setting section 203 is the section that sets the air/fuel ratio compensation coefficient FAF based on the set target air/fuel ratio lambda TG and the output lambda of the air/fuel ratio sensor 36. Details of the setting of the air/fuel ratio compensation coefficient FAF is disclosed, for example, in Japanese Non-Examined Patent Publication No. Hei 1-110853 and are known to be set according to the following equation.

$$FAF\ (k) = K1 \times \text{lambda}\ (k) + K2 \times FAF\ (k-3) + K3 \times FAF\ (k-2) + K4 \times FAF\ (k-1) + ZI\ (k) \quad (1)$$

Here, ZI (K) is defined as follows.

$$ZI(k)=ZI(k-1)+Ka\times(\text{lambda}\ TG-\text{lambda}(k))$$

In these equations, k is a variable expressing the number of controls from the start of the initial sampling. K1 to K4 are the optimum feedback constants, and Ka is an integration constant.

The FAF memory 204 is a memory for temporary storage of the air/fuel ratio compensation coefficient FAF set as described. However, the stored air/fuel ratio compensation coefficient FAF is compensated when necessary via a purge FAF compensation section 218 to be described below.

An air/fuel ratio learning control section 205 is a section for learning the air/fuel ratio deviation for each operational range according to the running conditions of the engine 10 with the condition (condition B) that the learning conditions are satisfied. More concretely, there is derivation of the deviation from the standard values (i.e., 1.0) of the average value FAFAV of the air/fuel ratio compensation coefficient FAF for each operational range, and learning is carried out according to the deviation that is obtained.

Furthermore, the learning conditions to be satisfied as the condition B include the following conditions:

(B1) there is presently control of air/fuel ratio feedback;

(B2) the cooling water temperature THW is 80° C. or higher;

(B3) the increase volume since start is "0";

(B4) the warming up increase volume is "0";

(B5) the process has progressed the designated crank angle since entry to the present operational range;

(B6) the battery voltage is 11.5 V or greater; and (B7) purge has not been carried out (the value of the purge execution flag XPRG is "0".

Whether learning of the air/fuel ratio has been completed by the air/fuel ratio learning control section 205 or not is set in the flag XAFLN memory 206 as a flag. The value learned is stored in the learning value memory 207 as the air/fuel ratio learning value KGj (where j is the operational range recognition element). The learning value memory 207 is disposed on the backup RAM 24 with battery backup as a memory including a storage area corresponding to the operational ranges.

In the control device 20, a fuel injection amount or volume setting section 208 is the section that carries out the following computation based on the learning value corresponding to the present running conditions among the following: the basic fuel injection volume Tp computed via the basic fuel injection volume computation section 201, the air/fuel ratio compensation coefficient FAF stored in the FAF memory 204, and the air/fuel ratio learning value KGj stored in the learning value memory 207. It then sets the final fuel injection volume TAU by multiplication.

$$TAU=FAF\times Tp\times \text{FALL}\times KGj \quad (2)$$

FALL is another compensation coefficient that is not dependent on the air/fuel ratio compensation coefficient FAF and the air/fuel ratio learning value KGj.

Moreover, the computed and set fuel injection volume TAU is given to the fuel injection valve 16 as the information on operational volume (operational time) of the fuel injection valve 16 (16*a* to 16*b*) to drive the valves.

Meanwhile, at the control device 20, the purge ratio control section 210 is the section to determine under the following conditions (condition C) whether to carry out the purge or not, and then set and control the purge ratio:

(C1) it is during control of air/fuel ratio feedback;

(C2) air/fuel ratio learning is completed;

(C3) the cooling water temperature is 60° C. or higher; and (C4) there has been no fuel cut.

When it is determined, according to the purge ratio control section 210, that purge should be carried out, the purge execution flag XPRG is set in the flag XPRG memory 212 (XPRG=1) and the flag XPRG is cleared in other cases (XPRG=0).

Moreover, the purge ratio PGR as set by the purge ratio control section 210 is temporarily stored in the PGR memory 213. In the PGR memory 213 are stored at least two values: the purge ratio PGRi−1 prior to updating and the purge ratio PGRi following updating.

Also, at the purge ratio control section 210, in setting the purge ratio PGR, there is reference to the three following values: the full open purge ratio PGRMX registered in the PGRMX map 211, the purge ratio gradual change value PGRD stored in the PGRD memory 215, the target purge ratio PGRO registered in the PGRO memory 216. The minimum value of these various values is determined as the purge ratio PGR each time.

The full open purge ratio PGRMX map 211, as is shown in FIG. 12, is a two-dimensional map determined by the value of the engine rotational speed Ne and the load represented by the intake air pressure PM, etc. It expresses the ratio of the total air volume flowing into the engine 10 via the intake air pipe 12 and the air volume flowing in via the purge pipe 43 when the purge solenoid valve is full open (duty 100%).

The purge ratio gradual change value PGRD stored in the PGRD memory 215 is the value derived each time through gradual change control (to be mentioned later) with the purge ratio gradual change control section 214.

The purge solenoid valve control section 217 is the section which generates and outputs the drive signal PD of the purge solenoid valve 45 on the condition that the purge execution flag XPRG is set in the flag XPRG memory 212.

Upon generation of the drive signal PD, the purge solenoid valve control section 217 carries out the following computation to derive the control value duty based on the purge ratio PGR stored in the PGR memory 213 and the full open purge ratio PGRMX.

$$\text{Duty}=(\text{PGR}/\text{PGRMX})\times(100-\text{PV})\times\text{Ppa}+\text{Pv} \quad (3)$$

Moreover, according to equation (3), the drive cycle of the purge solenoid valve 45 is considered to be 100 ms (milliseconds). Also, in equation (3), Pv is the voltage compensation value relative to fluctuations in battery voltage (time-related value for compensating the drive cycle) and Ppa is the atmospheric pressure compensation value relative to fluctuations in the atmospheric pressure.

In the control device 20, the purge FAF compensation section 218 reads the two purge ratio PGR from the PGR memory 213 both before and after the updating on the condition that the purge execution flag XPRG is set in the flag XPRG memory 212 and compensates the air/fuel ratio compensation coefficient FAF stored in the FAF memory 204 if the purge ratio PGR fluctuation amounts are above a determined value.

Incidentally, in the device 20 in the present embodiment, if the number of compensations (control count) is i, the purge ratio before updating is PGRi−1, the purge ratio after updating is PGRi, and the previous value of the change amount of the air/fuel ratio compensation coefficient FAF based on the purge ratio change is ΔFAFi−1 (hereinafter denoted as deltaFAFi−1) with "1" inserted as the initial value, for example, the present compensation value ΔFAFi (deltaFAFi) for the compensation coefficient FAF is computed according to the following formula:

$$\text{delta}FAFi=(PGRi/PGRi-1)\ \text{delta}FAFi-1 \quad (4).$$

There is then averaging of the derived compensation value deltaFAFi with the following formula:

$$(\text{delta}FAFi-1-\text{delta}FAFi)/2.$$

Then, regarding the air/fuel ratio compensation coefficient FAF there is subtraction from the previous compensation value FAFi−1 as expressed below:

$$FAF=FAFi-1-(\text{delta}FAFi-1-\text{delta}FAFi)/2 \quad (5)$$

thus obtaining the present value FAF regarding the compensation coefficient FAF.

If there is compensation of the air/fuel ratio compensation coefficient FAF stored in the FAF memory 204, then in the prior fuel injection amount setting section 208 there is execution of equation (2) based on the compensated air/fuel ratio compensation coefficient FAF to set the fuel injection amount TAU.

Next follows a more detailed description of a series of processes of the device 20 in the embodiment with reference to FIGS. 4 to 16A–16C.

(Air/Fuel Ratio Control)

First there is a description of air/fuel ratio control which is carried out via the following sections of the electronic control device 20: the basic fuel injection amount computation section 201, the target air/fuel ratio setting section 202, the air/fuel ratio compensation coefficient setting section 203, the FAF memory 204, the fuel injection amount setting section 208.

Figure 4:
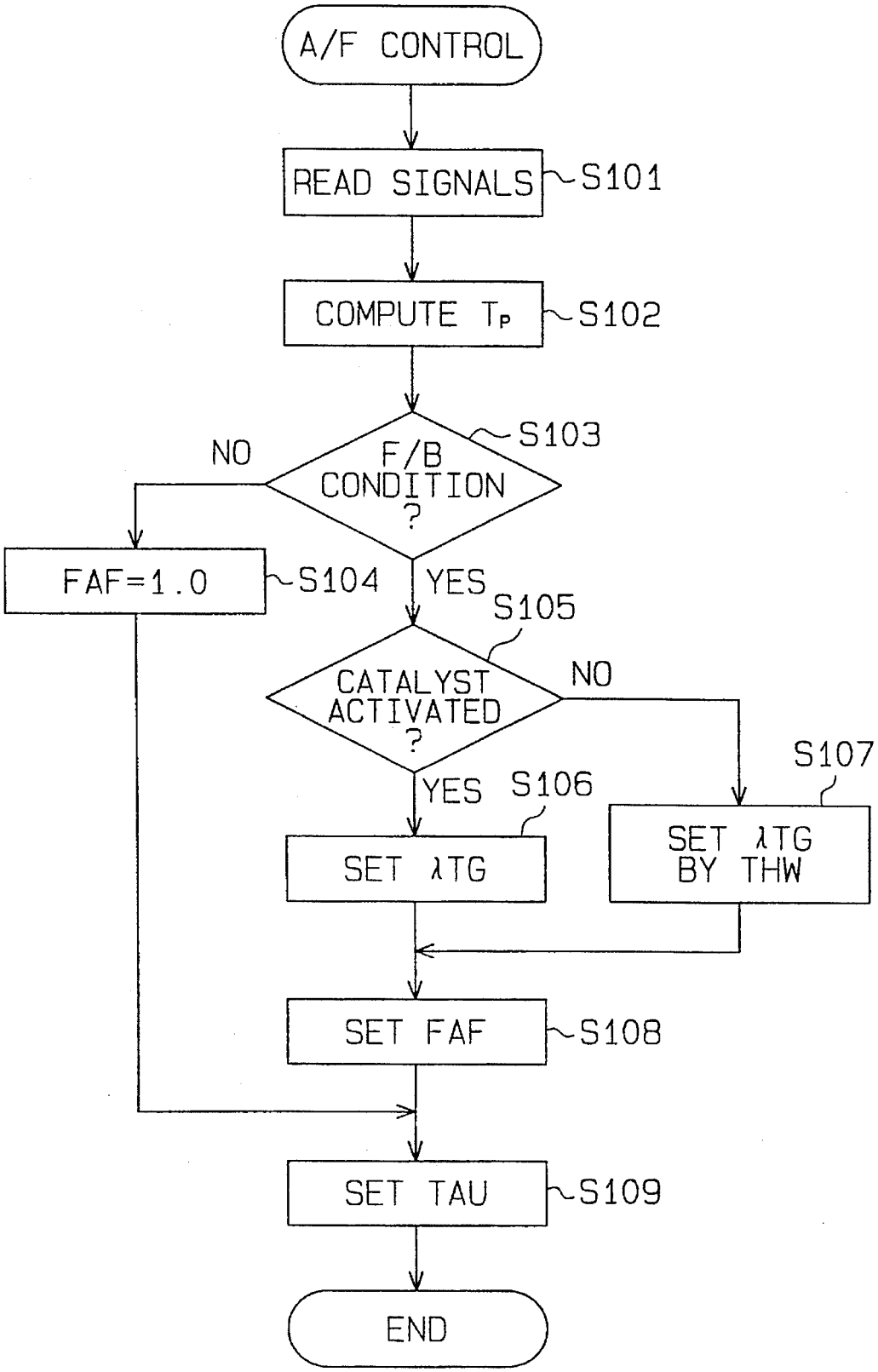
FIG. 4 is a flowchart showing the control process of the air/fuel ratio control apparatus in the embodiment.

FIG. 4 shows the routine for setting the fuel injection amount TAU by means of feedback control of the air/fuel ratio. This routine is executed, for example, every 360° CA (crank angle) in synchronism with rotation of the engine 10.

In the air/fuel ratio control routine, the electronic control device 20 first reads the detection signals (e.g., rotational speed Ne, intake air pressure PM, cooling water temperature THW, air/fuel ratio lambda, oxygen density R/L, etc.) from the sensors at step S101. Then, at step S102, the basic fuel injection amount Tp is computed in accordance with the rotational speed Ne and the intake air pressure PM via the basic fuel injection amount computation section 201.

Next, at step S103, the control device 20 detects whether the air/fuel ratio feedback conditions are satisfied or not. The air/fuel ratio feedback conditions are the conditions (A1) to (A4) described above as condition A, that is, the following AND conditions:

(A1) there are no fuel increase compensations;

(A2) it is not during a fuel cut;

(A3) it is not during high load running; and (A4) the air/fuel ratio sensor 36 is activated.

Moreover, regarding (A4) concerning the activation of the air/fuel ratio sensor 36, this can be determined by a variety of methods such as the following:

detecting whether or not the cooling water temperature THW which is an output of the warming-up sensor 33 is above a predetermined value or not (e.g., a value corresponding to 30° C.);

detecting the time elapsed before and after start, and whether the output from the air/fuel ratio sensor 36 has actually been output or not; and detecting the impedance of the element.

If the air/fuel ratio feedback conditions have not been satisfied, then, at step S104, the air/fuel ratio compensation coefficient FAF is set at "1.0" and the process proceeds to step S109. There is no compensation of the air/fuel ratio in such a case.

On the other hand, if the air/fuel ratio feedback conditions are satisfied, then, at step S105, the control device 20 determines whether the three-way catalyst 38 is activated or not. Regarding whether the three-way catalyst 38 is activated or not, this can also be determined according to whether the value of the cooling water temperature THW is above a determined value or not (e.g., a value corresponding to 40° C.).

If it is determined that the three-way catalyst 38 is activated, then, at step S106, there is setting of the target air/fuel ratio lambda TG based on the output R/L from the $O_2$ sensor 37, after which the process proceeds to step S108. Furthermore, the actual setting state of the target air/fuel ratio lambda TG based on the output R/L of the $O_2$ sensor 37 will be explained in detail later referring to FIG. 7.

On the other hand, if it is determined at step S105 that the three-way catalyst 38 is not activated, then, at step S107, there is setting of a target air/fuel ratio lambda TG corresponding to the cooling water temperature THW before proceeding to step S108.

Figure 5:
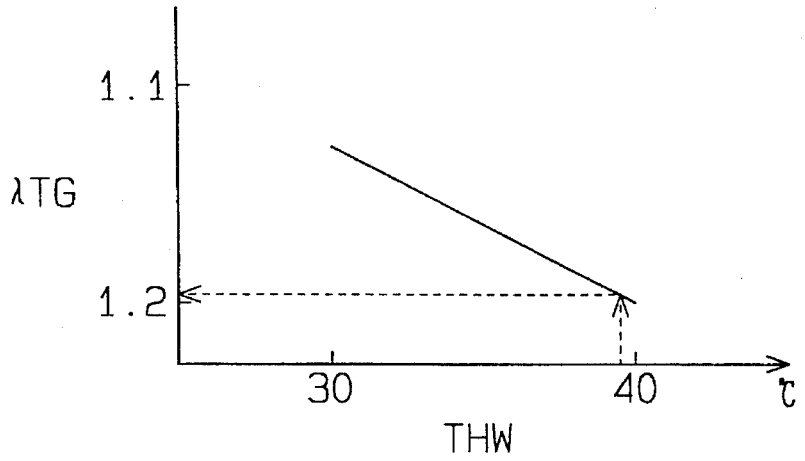
FIG. 5 is a graph showing setting state for the target air/fuel ratio based on cooling water temperature carried out prior to activation of the three-way catalyst in the embodiment.
Figure 6:
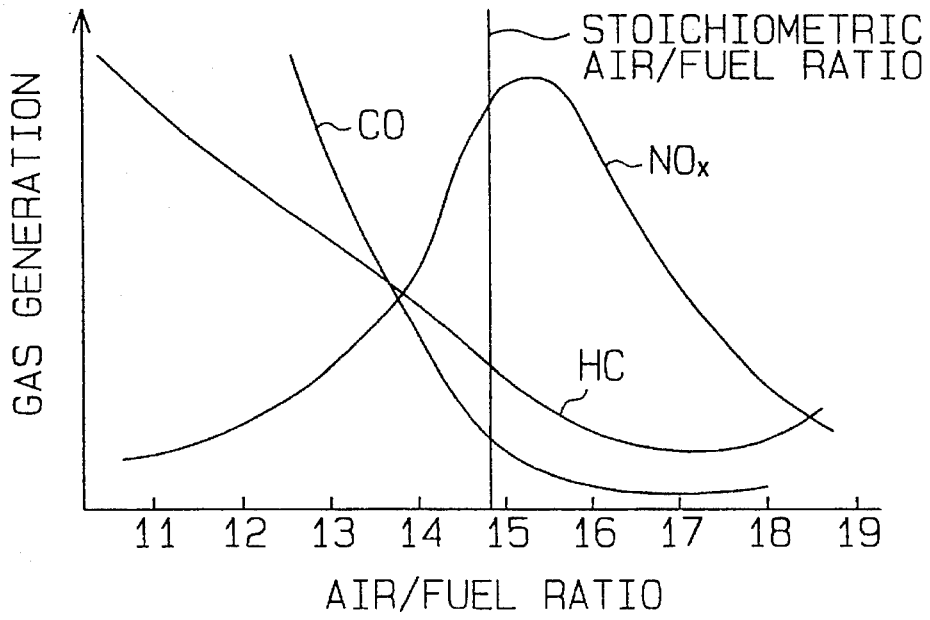
FIG. 6 is a graph showing the relationship between the air/fuel ratio and emission volumes of harmful components of the exhaust gas (CO, HC, NOx)

FIG. 5 shows the relationship with the target air/fuel ratio lambda TG set according to the cooling water temperature THW by data mapping (table) in the ROM 22, etc.

As is shown in FIG. 5, in the present embodiment, when it is determined that the three-way catalyst 38 is not activated, the target air/fuel ratio lambda TG is set according to the value of the cooling water temperature TWH "Approximately 1.2 (absolute air/fuel ratio 17 to 18). As is made clear in the graph shown in FIG. 6, the absolute air/fuel ratio 17 to 18 correspond to an air/fuel ratio where the generation volumes of harmful substances (NOx, HC, CO) are all small. In other words, in operational ranges where the three-way catalyst 38 is not activated so that the purifying function is not sufficiently obtained, an air/fuel ratio where it is possible to reduce generation of the harmful substances is selected as the target air/fuel ratio lambda TG to prevent worsening of emissions from start of air/fuel ratio feedback until the three-way catalyst 38 reaches an activated state.

Next, at step S108, the control device 20 which sets the target air/fuel ratio lambda TG via the target air/fuel ratio setting section 202, sets the air/fuel ratio compensation coefficient FAF by means of the equation (1) above based on the set target air/fuel ratio lambda TG and the output lambda of the air/fuel ratio sensor 36. As was mentioned above, the setting of the air/fuel ratio compensation coefficient FAF is carried out in the control device 20 via the air/fuel ratio compensation coefficient setting section 203. As was also mentioned above, the value of the set air/fuel ratio compensation coefficient FAF is compensated when necessary via the purge FAF compensation section 218.

At the following step S109, the control device 20 which has obtained the air/fuel ratio compensation coefficient FAF in addition to the basic fuel injection amount Tp computes and sets the final fuel injection amount TAU via the fuel injection amount setting section 208. As was mentioned already above, computation of the final fuel injection volume TAU is carried out based on the equation (2) above, and a pulse signal corresponding to the computed fuel injection volume TAU is applied to the fuel injection valve 16 as information on the operational amount (operational time) of the fuel injection valve 16 (16*a* to 16*d*).

Figure 7:
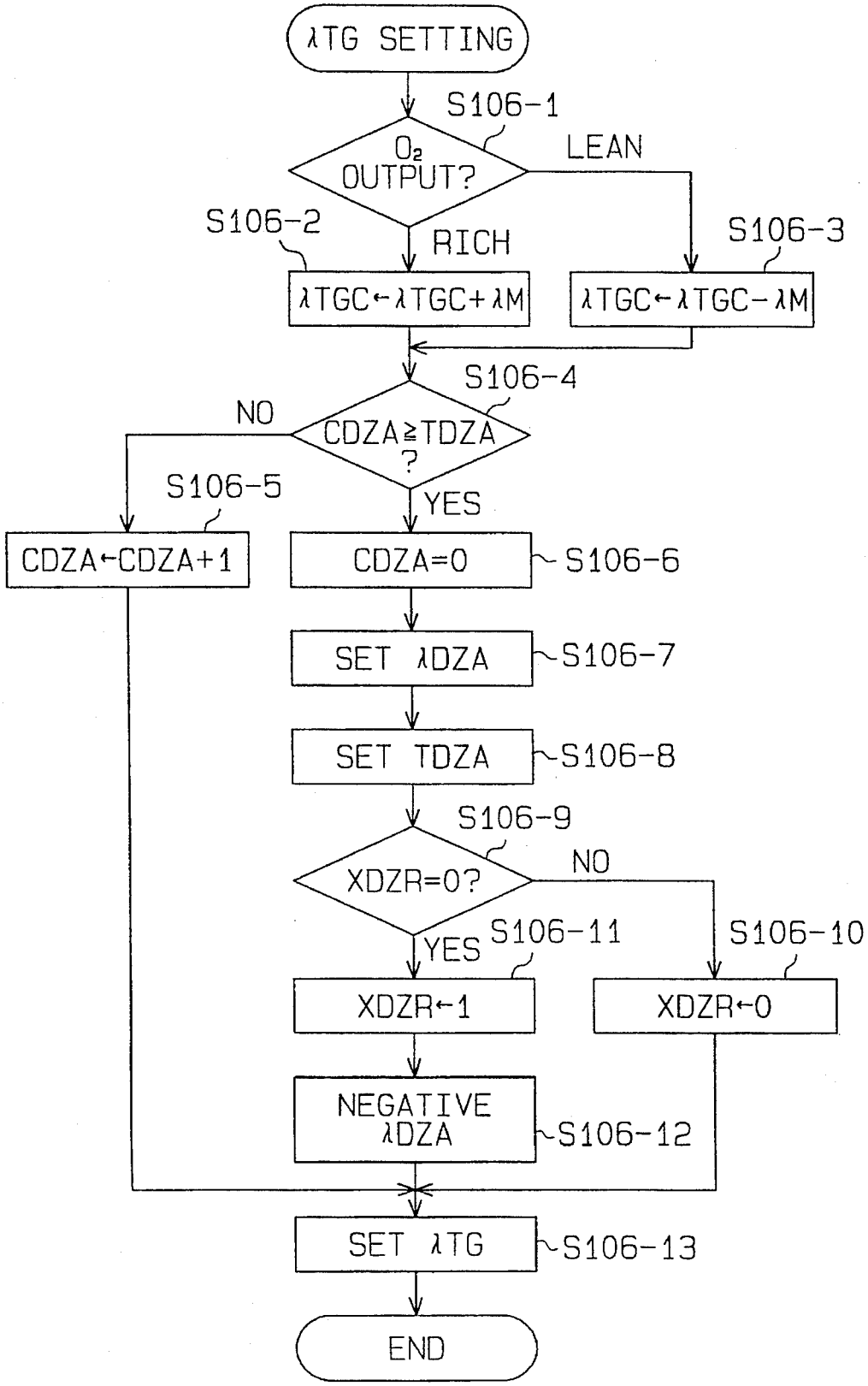
FIG. 7 is a flowchart showing the setting process of the target air/fuel ratio carried out prior to activation of the three-way catalyst in the embodiment.

Next, follows a description based on FIG. 7 regarding the setting process of the target air/fuel ratio lambda TG following activation of the three-way catalyst 38 carried out as step S106 in FIG. 4 via the target air/fuel ratio setting section 202.

The target air/fuel ratio setting routine shown in FIG. 7 is the routine of step S105 of the air/fuel ratio control routine (FIG. 4). This routine is also carried out in synchronism with rotation of the engine 10 at a rate of every 360° CA, for example.

Regarding the target air/fuel ratio setting routine, in steps S106-1 to step S106-3, there is setting of the central value lambda TGC of the target air/fuel ratio in order to compensate the deviation between the actual air/fuel ratio and the output lambda of the air/fuel ratio sensor 36 depending on the output R/L of the $O_2$ sensor 37.

More concretely, at step S106-1, it is determined whether the output from the $O_2$ sensor 37 is rich (R) or lean (L).

If output from the $O_2$ sensor 37 is rich (R), the process proceeds to step S106-2 where the central value lambda TGC is increased by the set value lambda M; that is, it is set to lean by an amount equal to lambda M (lambda TGC←lambda TGC+lambda M).

If output from the $O_2$ sensor 37 is lean (L) in step S106-1, the process proceeds to step S106-3 where the central value lambda TGC is decreased by the set value lambda M; in other words, it is set rich by an amount equal to lambda M (lambda TGC←lambda TGC–lambda M).

FIGS. 8A and 8B show setting state of the target air/fuel ratio central value lambda TGC based on the output from the $O_2$ sensor 37.

Meanwhile, the steps from step S106-4 to step S106-13 are the steps of dither control.

At step S106-4 it is determined whether the count value CD of a dither period counter is greater than the dither period TDZA or not. The dither period TDZA is the factor that determines the resolution of the applicable dither control. With the device in the present embodiment, in the following step S106-8 there is setting each time of the desired value corresponding to the running condition of the engine 10.

If the count value CDZA of the period counter is less than the dither period TDZA, the process proceeds to step S106-5 where there is incrementing of the same counter (CDZA to CDZA+1) and execution of processing in step S106-13. In other words, in this case, without updating the value of the target air/fuel ratio lambda TG, the value of the target air/fuel ratio lambda TG set at that time is maintained.

In step S106-4, if it is determined that the count value CDZA of the dither period counter is greater than the dither period TDZA, there is resetting at the next step S106-6 of the counter value (CDZA=0). Afterwards, the following processes are carried out so that the target air/fuel ratio lambda TG alternates in accordance with the central value lambda TGC and thus changes in stepwise.

In step S106-7 and step S106-8 there is setting of the dither amplitude lambda DZA and the dither period TDZA, respectively.

The dither amplitude lambda DZA is the factor determining the control amount of the dither control, and is also set as a value that is desirable in accordance with the running conditions of the engine 10. With the device in the present embodiment, regarding the dither amplitude lambda DZA and the dither period TDZA, optimum values corresponding to the rotational speed Ne and the intake air pressure PM are determined and mapped in the ROM 22, etc. Based on the rotational speed Ne and the intake air pressure PM at each time, the corresponding values of the dither amplitude lambda DZA and the dither period TDZA are read from the map.

Next, at step S106-9 it is determined whether the flag XDZR for alternate processing has been set or not. Here, the flag XDZR is set when the target air/fuel ratio lambda TG is set at rich relative to the target air/fuel ratio central value lambda TGC (XDZR=1) and is cleared when the value is set at lean (XDZR=0).

In the same step S106-9, if it is determined that flag XDZR has been set, in other words, if the target air/fuel ratio lambda TG is set to rich relative to the central value lambda TGC at the previous control time, the process proceeds to step S106-10 where the flag XDZR is cleared (XDZR←0) so that the target air/fuel ratio lambda TG is set to lean to an extent equal to the dither amplitude lambda DZA relative to the central value lambda TGC.

Meanwhile, if it is determined in step S106-9 that the flag XDZR has not been set, that is, if the target air/fuel ratio lambda TG is set to lean relative to the central value lambda TGC by the previous control time, the process proceeds to step S106-11 where there is setting of the flag XDZR so that the target air/fuel ratio lambda TG is set rich relative to the central value lambda TGC to an extent equal to the dither amplitude lambda DZA (XDZR←1). When the flag XDZR is set in this way, in the following step S106-12 the value of the dither amplitude lambda DZA as set above is set to a negative value.

Then, at step S106-13 there is setting of the target air/fuel ratio lambda TG according to the following equation:

$$\text{lambda } TG = \text{lambda } TGC + \text{lambda } DZA \quad (6).$$

In other words, if the target air/fuel ratio lambda TG has been set to rich at the previous time relative to the central value lambda TGC (step S106-10), there is setting of the target air/fuel ratio lambda TG by the following equation so that the target air/fuel ratio lambda TG is set to lean to an amount equal to the dither amplitude relative to the central value lambda TGC, lambda TG=lambda TGC+lambda DZA. Conversely, if the target air/fuel ratio lambda TG has been set to lean at the previous time relative to the central value lambda TGC (step S106-11), there is setting of the target air/fuel ratio lambda TG according to the following equation so that the target air/fuel ratio lambda TG is set to rich relative to the central value lambda TGC to an amount equal to the dither amplitude lambda DZA.

$$\text{lambda } TG = \text{lambda } TGC - \text{lambda } DZA$$

FIGS. 9A and 9B show the setting process by which there is setting of target air/fuel ratio lambda TG by means of dither control.

(Air/fuel ratio learning control)

Next follows a description of air/fuel ratio learning control according to operational range as carried out via the air/fuel ratio learning control section 205 of the electronic control device 20.

Figure 10:
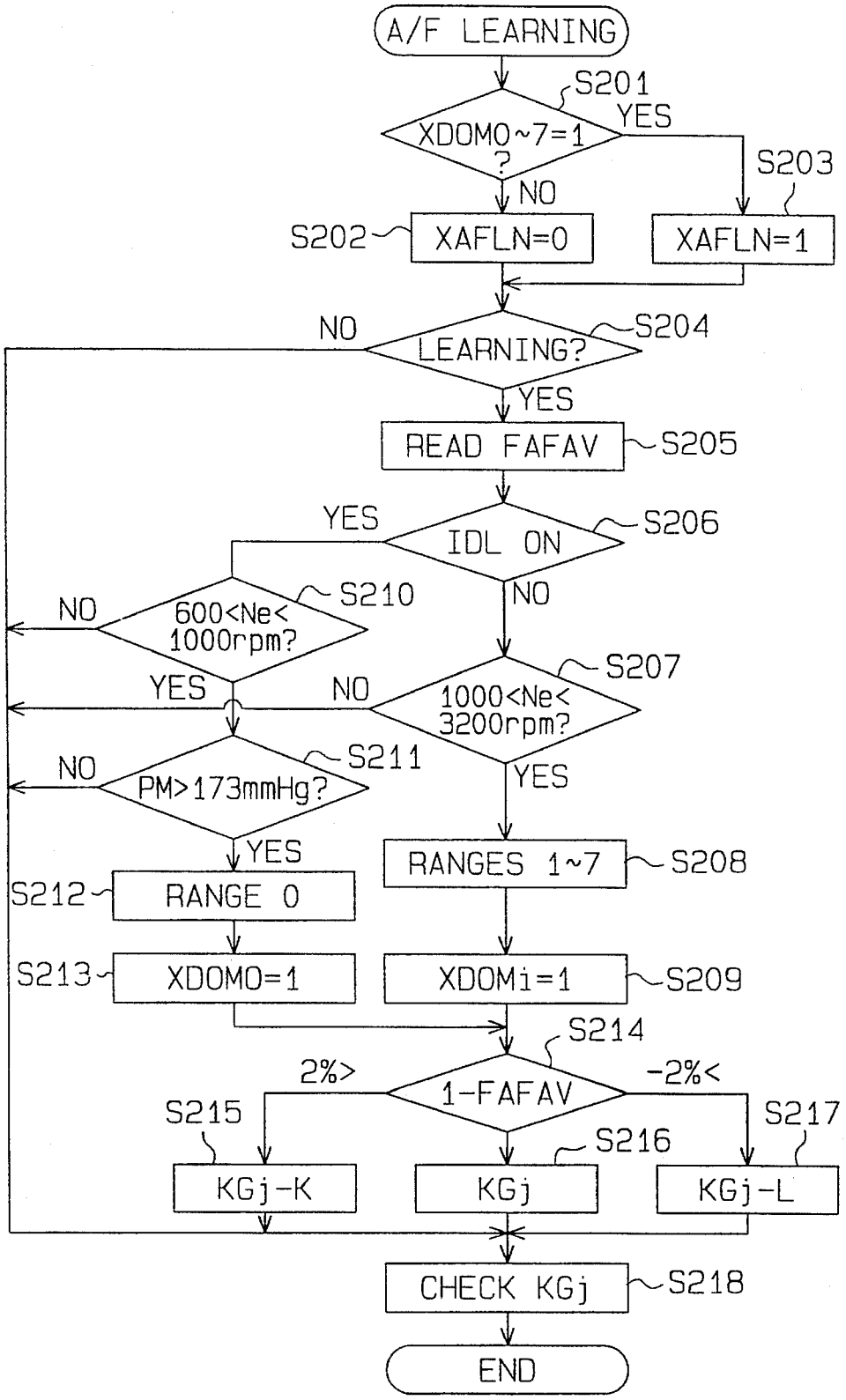
FIG. 10 is a flowchart showing the control process regarding air/fuel ratio learning control in the embodiment.

FIG. 10 shows the control routine related to air/fuel ratio learning control. The routine shown here is executed for each designated crank angle of the engine 10.

In the air/fuel ratio learning control routine, the electronic control device 20, at step $201, first determines whether air/fuel ratio learning has finished or not regarding the ranges "0" to "7" of the 8 operational ranges, for example, described below. This determination is carried out according to whether the learning flags XDOM0 to XDOM7 corresponding to the operational ranges are all set (XDOM0–XDOM7=1) or not.

If it is determined by the electronic control device 20 via step S201 that air/fuel ratio learning has been completed for all operational ranges "0" to "7", then, at step S203, there is setting of the learning completion flag XAFLN (XAFLN=1) in the flag XAFLN memory 206. The process then proceeds to processing in step S204. On the other hand, if any one of operational ranges from "0" to "7" is determined not to have completed air/fuel ratio learning, then, at step S202, the electronic control device 20 clears the learning end flag XAFLN (XAFLN=0). The process then proceeds to the same step S204 for next processing.

At step S204 it is determined whether the conditions listed above (B1) to (B7) as condition B are satisfied or not:

(B1) there is presently control of air/fuel ratio feedback;

(B2) the cooling water temperature THW is 80° C. or higher;

(B3) the fuel increase volume since start is "0;.

(B4) the warming-up fuel increase volume is "0";

(B5) the process has only progressed the set crank angle since entry to the present operational range;

(B6) the battery voltage is 11.5 V or greater; and (B7) purge has not been carried out (the purge execution flag XPRG is "0").

If it is determined with the electronic control device 20 that any one of these conditions is not satisfied, the routine is temporarily terminated at that point. Only when all conditions have been satisfied is there execution of operational range specific learning control in the next step S205 and in subsequent steps.

As for learning control, at step S205 there is reading of the average value FAFAV of the air/fuel ratio compensation coefficient FAF as stored in the FAF memory 204. At the next step S206 it is determined whether there is an idle state (IDLON) and, based on those results (i. e., according to whether it is idle time or running time), the following separate learning processes are carried out.

First, if it is determined at step S206 that it is running time, the electronic control device 20, on the condition that the rotational speed Ne at that time is "1000 to 3200 rpm" (step S207), determines the operational range of the engine 10. Such a determination of the operational range is carried out according to the load (e.g., intake air pressure PM) of the engine 10. According to the size of the load, there is setting of one of the operational ranges (operational range "1"-operational range "7") as the applicable learning process operational range (step S208). The electronic control device 20 then sets a learning flag XDOMi corresponding to the operational range i that was set (i being any one of the operational ranges from "1" to "7") (step S209).

On the other hand, if it is determined at step S206 that the engine is in idle, the electronic control device 20, on the conditions that the rotational speed Ne at that time is "600 to 1000 rpm" (step S210) and the intake air pressure PM is 173 mmHg or greater (step S211), determines that learning processing is possible and sets the operational range to operational range "0" (step S212). It then sets the learning flag XDOM0 corresponding to the set operational range "0" (step S213).

The electronic control device 20, having set the learning flag XDOMi or XDOM0 corresponding to the operational range of the engine 10 at that time, then carries out in steps S214 to S217 the setting of the air/fuel ratio learning value KGj (where "j" is the operational range identification element, in this example from "0" to "7") or carries out updating of the learning value KGj that has already been set.

In other words, setting or updating of the learning value KGj is based on the difference between the average value FAFAV and the standard value (1.0 in this case) of the air/fuel ratio compensation coefficient FAF read as described above (step S214). It is furthermore carried out as follows:

if the difference (1-FAFAV) is larger than the designated value (e.g., 2%), the learning value KGj of the applicable range is compensated by a designated value of K % (step S215);

if the value is less than the designated value (e.g., −2%) the learning value KGj of the applicable range is compensated by a designated value of L % (step S217); and if the difference is within the designated values, the learning value KGj of the applicable operational range is not compensated but maintained (step S216).

Finally, at step S218, there is execution with the electronic control device 20 of upper/lower limit check of the learning values KGj which were set or updated as described above. In the upper/lower limit check, the upper limit value of the learning value KGj is set, for example, to "1.2" and the lower limit value to "0.8". The lower and upper limit values can also be set for each operational range of the engine 10 as described above. As was also mentioned above, the learning value KGj set in this way is stored in the corresponding memory area of the learning value memory 207 separate from the operational ranges.

(Purge ratio control)

Next follows a description of purge ratio control carried about via the purge ratio control section 210 of the electronic control device 20.

Figure 11:
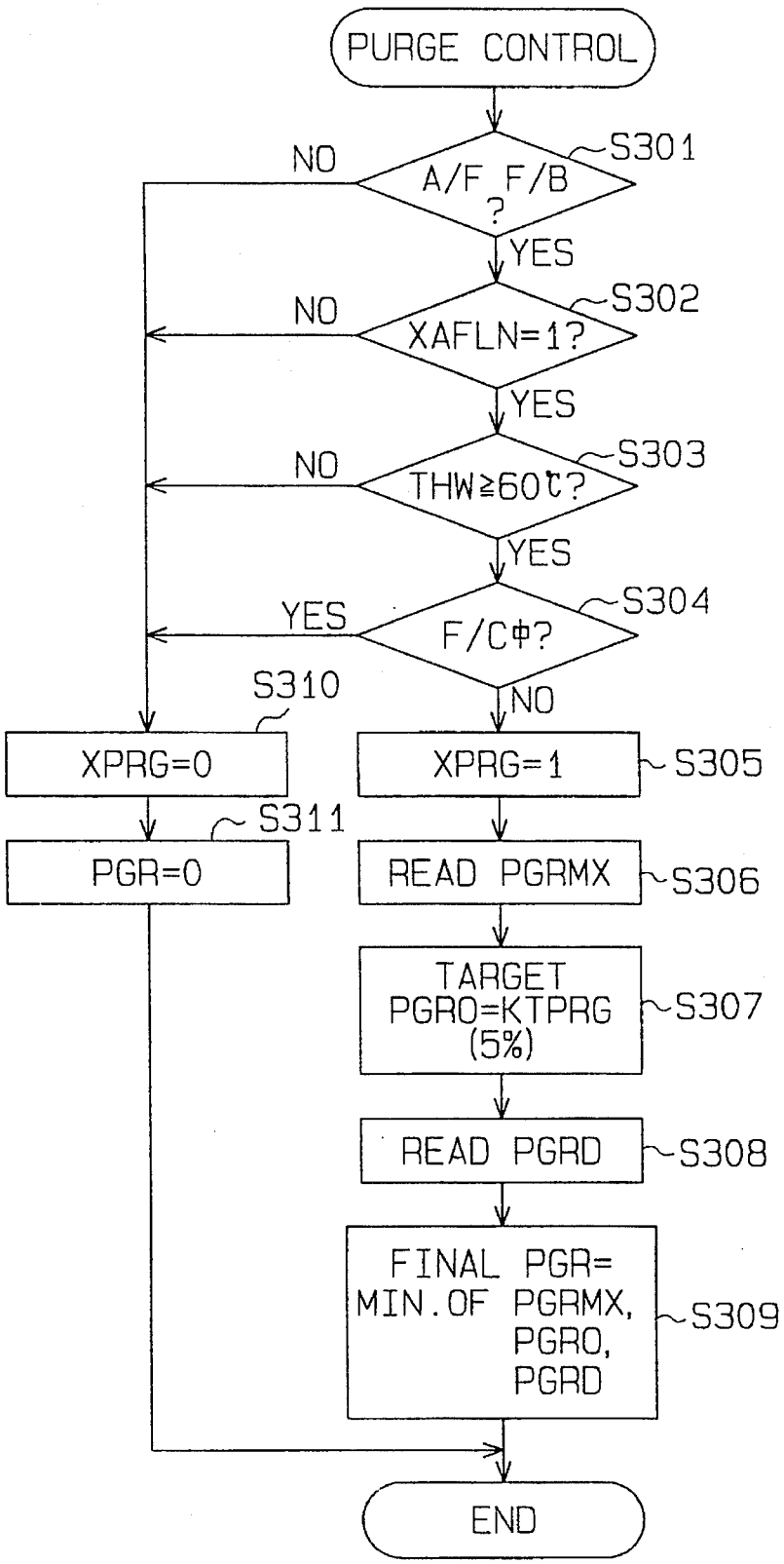
FIG. 11 is a flowchart showing the control process regarding purge ratio control in the embodiment.

FIG. 11 shows the setting routine of the purge ratio corresponding to purge ratio control. This routine is executed at a time interrupt of 32 ms, for example.

In the purge ratio control routine the electronic control device 20 first carries out determination in step S301, step S302, step S303 and step S304 whether the conditions listed above (C1) to (C4) as condition C are satisfied or not;

(C1) it is during control of air/fuel ratio feedback (S301);

(C2) air/fuel ratio learning is completed (S302);

(C3) the cooling water temperature is 60° C. or higher (S303); and (C4) there has been no fuel cut (S304).

Incidentally, the condition (C1) is included to eliminate conditions such as start control. The condition (C2) is to insure that deviation amounts of the air/fuel ratio compensation coefficient FAF other than those caused by purge are not included in the air/fuel ratio compensation coefficient FAF deviation amount when carrying out purge. The condition (C3) is to eliminate conditions in which fuel increase compensation (low-temperature fuel increase) is carried out other than by purge. The condition (C4) is to insure that purge is not carried out during the fuel cut.

If it is determined that all these conditions are satisfied, there is setting at step S305 of the purge execution flag XPRG at the electronic control device 20 (purge ratio control section 210). In other words, XPRG=1. In other cases, the process proceeds to step S310 where there is clearing of the purge execution flag XPRG (XPRG=0) and, at step S311, the final purge ratio PGR is set to "0" to end the process. If the final purge ratio PRG is "0", it means that purge is not carried out.

The electronic control device 20, which set the purge execution flag XPRG in the step S305, then reads in step S306 from the PGRMX map 211 the full open purge ratio PGRMX corresponding to the rotational speed Ne and intake air pressure PM at that time. As is shown in FIG. 12, the PGRMX map 211 is a two-dimensional map determined by the engine rotational speed Ne and the intake air pressure PM. This value expresses the ratio of the total air volume flowing into the engine 10 via the intake air pipe 12 and the air volume passing through the purge pipe 43 when the purge solenoid valve 45 is fully open (at duty 100%).

Then, at step S307, the electronic control device 20 reads the target purge ratio PGRO from the PGRO memory 216. The target purge ratio PGRO is stored beforehand as the constant KTPRG in the PGRO memory 216 which is composed either of the RAM 23 or the backup RAM 24. With the device in the present embodiment the target purge ratio PGRO is set to "5%". Then, at step S308, the electronic control device 20 reads the purge ratio gradual change value PGRD from the PGRD memory 215. The purge ratio gradual change value PGRD is a control value that is used in order to avoid a situation where compensation cannot keep up when the purge ratio is suddenly changed a large amount and it is not possible to maintain the optimum air/fuel ratio. The section below on purge ratio gradual change control provides a detailed description of how the purge ratio gradual change value PGRD is determined.

Having obtained the full open purge ratio PGRMX, the target purge ratio PGRO and the purge ratio gradual change value PGRD, then, at step S309, the electronic control device 20 (purge ratio control section 210) determines the minimum value of these values as the final purge ratio PGR. Purge control is then carried out with this final purge ratio PGR. (Purge ratio gradual change control)

Next follows a description of how purge ratio gradual change control is carried out via the purge ratio gradual change control section 214 of the electronic control device 20.

Figure 13:
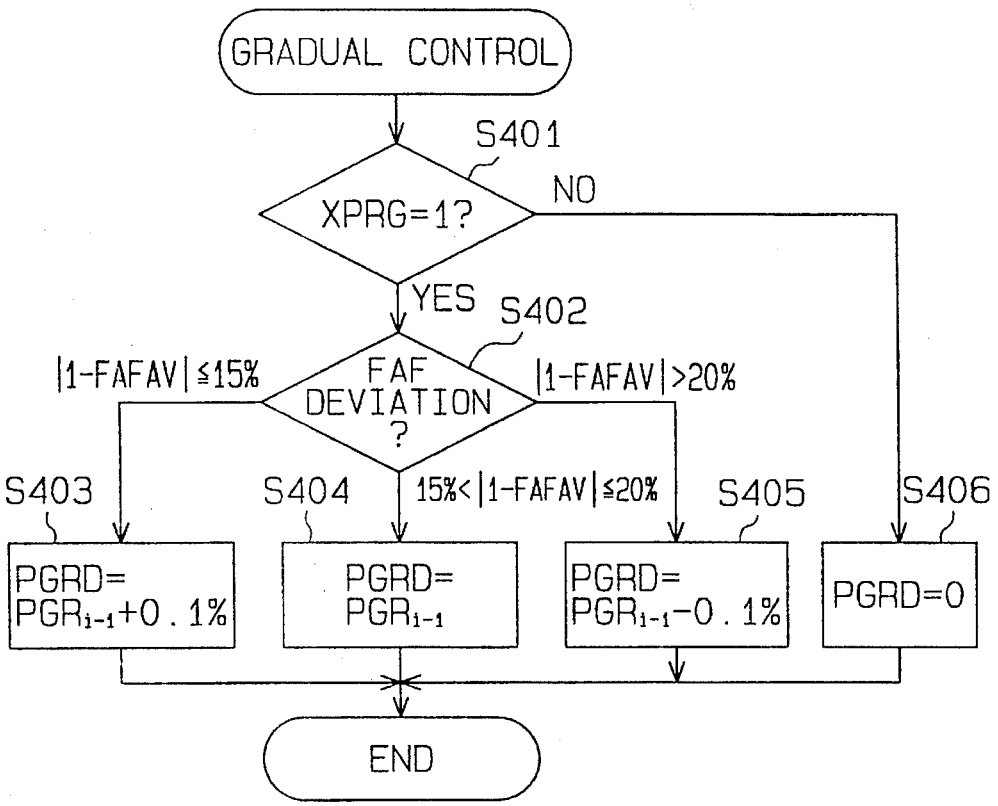
FIG. 13 is a flowchart showing the control process concerning the purge ratio gradual change control in the embodiment.

FIG. 13 shows the setting routine for the purge ratio gradual change value PGRD related to purge ratio gradual change control. As was the case above with the purge ratio control routine, this routine is executed at a time interrupt of 32 ms, for example.

In the purge ratio gradual change control routine, at step S401 the electronic control device 20 (purge ratio gradual change control section 214) checks whether there is setting of the purge execution flag XPRG to the flag XPRG memory 212.

If the flag XPRG is cleared, (i.e., XPRG=0), the process proceeds to step S406 where the purge ratio gradual change value PGRD becomes 0 and the process is ended.

On the other hand, if the flag XPRG is set (i.e., XPRG=1), the process proceeds to step S402 where there is determination of the deviation amount "|1−FAFAV|" of the air/fuel ratio compensation coefficient FAF as stored in the FAF memory 204. FAFAV means the average value of the air/fuel ratio compensation coefficient FAF.

If, according to the determination, the deviation amount is 15% or less, that is, $|1-FAFAV| \leqq 15\%$, then, at step S403, "0.1%" is added to the previous final purge ratio PGRi−1 to set the purge ratio gradual change value PGRD. Also, if determination shows that the deviation amount is a further 20% or less, that is, $15\% < |1-FAFAV| \leqq 20\%$, then, at step S404, there is setting of the previous purge final purge ratio PGRi−1 as the purge ratio gradual change value PGRD.

Furthermore, if the determination shows that the deviation amount exceeds 20%, that is, $|1-FAFAV| > 20\%$, then, at step S405, "0.1%" is subtracted from the previous final purge ratio PGRi−1 to set the purge ratio gradual change value PGRD.

As was explained above, the purge ratio gradual change value PGRD set in this way is a control value that is used in order to avoid a situation where compensation cannot keep up when the purge ratio is suddenly changed a large amount and it is not possible to maintain the optimum air/fuel ratio.

(Purge solenoid valve control)

Next follows a description of purge solenoid valve control as carried out via the purge solenoid valve control section 217 of the electronic control device 20.

Figure 14:
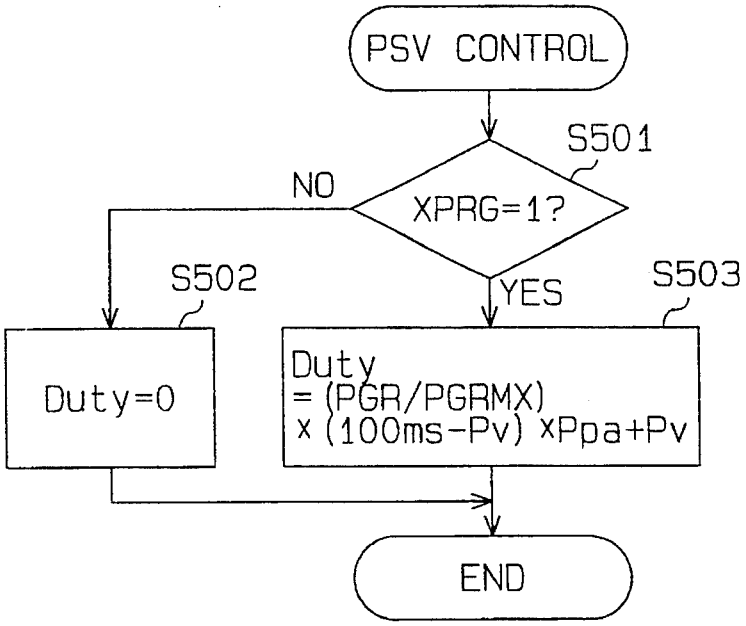
FIG. 14 is a flowchart showing the control process regarding purge solenoid control in the embodiment.

FIG. 14 shows the control routine of the purge solenoid valve 45 concerning purge solenoid valve (PSV) control. This routine is executed at a time interrupt of 32 ms, for example.

In the present purge solenoid valve control routine, at step S501, the electronic control device 20 (purge solenoid valve control section 217) checks whether there has been setting of purge execution flag XPRG to the flag XPRG memory 212.

If the flag XPRG is cleared, then, at step S502, the control value duty of the purge solenoid valve 45 is made "0". On the other hand, if the flag XPRG is set, then, at step S503, there is computation of equation (3) above based on a full open purge ratio PGRMX matching the purge ratio PGR stored in the PGR memory 213 and the running conditions at that time, thus determining the control value duty of the purge solenoid valve 45. As was mentioned already, the duty ratio of the drive signal (pulse signal) PD is set according to the control value duty.

(Purge FAF compensation)

Next follows a description of purge FAF compensation processing as carried out via the FAF compensation section 218 of the electronic control device 20.

Figure 15:
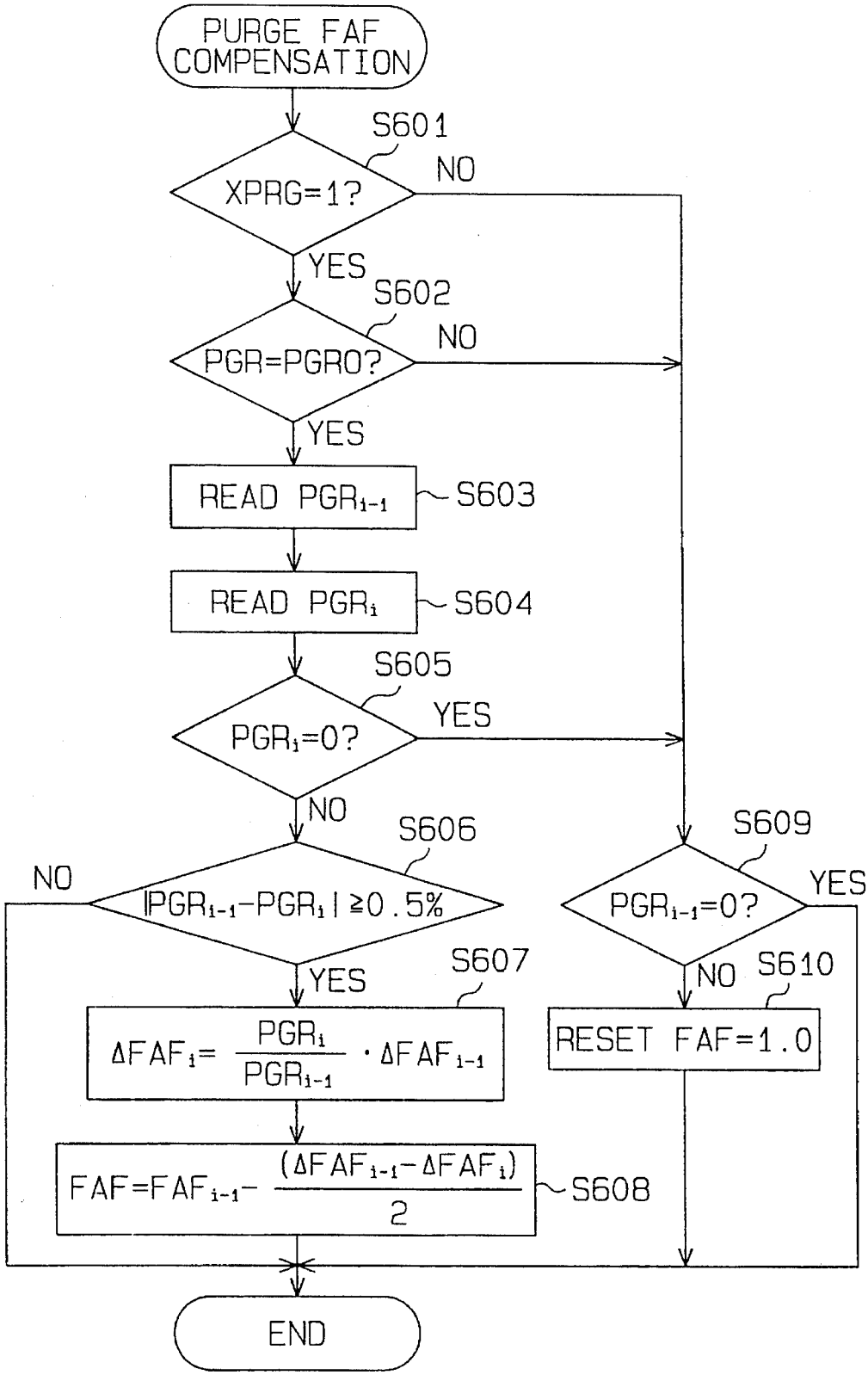
FIG. 15 is a flowchart showing the compensation process regarding compensation of the purge FAF (air/fuel ratio compensation coefficient) in the embodiment.

FIG. 15 shows the processing routine concerned with purge FAF compensation processing. This routine, as was the case with the previous purge ratio control routine and the purge ratio gradual change control routine, is executed at a time interrupt of 32 ms, for example.

In the purge FAF compensation routine, at step S601, the electronic control device 20 (purge FAF compensation section 218) determines whether there has been setting of the purge execution flag XPRG to the flag XPRG memory 212.

If the flag XPRG has been cleared (i.e., purge has not been carried out), then, at step S609, it is determined whether the previous purge ratio PRGi−1 is "0" or not (i.e., whether PRGi−1=0). If it is determined as a result that PRGi−1=0, because there has been no purge carried out since the previous time, the electronic control device 20 determines that it is not necessary to carry out compensation of the air/fuel ratio compensation coefficient FAF, and processing ends at that point.

On the one hand, if, as the result of the determination carried out in step S609, it is determined that PRGi−1 does not equal 0, it indicates that purge was carried out up to the previous time. In such a case, in the next step S610, the air/fuel ratio compensation coefficient FAF is set to the central value of "1.0".

On the other hand, if it is determined at the step S601 that the purge execution flag XPRG has been set (i.e., that purge was being carried out), then, at the following step S602, it is determined whether the purge ratio PGR that was set at that time in the PGR memory 213 has reached the target purge ratio PGRO.

Then, on the condition that the purge ratio PGR has reached the target purge ratio PGRO, at steps S603 and S604 there is reading of the previous and present purge ratio PRGi−1 and PRGi from the PGR memory 213.

If the purge ratio PGR has not reached the target purge ratio PGRO, or if it is determined as a result of step S605 that the purge ratio PGRi that was read the present time is "0", there is execution of the same processes as in steps S609 and S610.

If it is determined at the step S605 that PRGi does not equal 0, then, at the next step S606, the purge ratio PGR change amount "|PRGi−1−PRGi|" is derived and it is furthermore determined whether the applicable change amount is above the designated value (e.g., 0.5%) or not.

If it is determined as a result of the determination that the purge ratio change amount is less than "0.5%", the change of the air/fuel ratio compensation coefficient FAF due to purge is small and it is determined that there is no need to carry out compensation of the coefficient FAF so that processing ends at that point.

On the other hand, if it is determined as a result of determination that the purge ratio change amount is greater than "0.5%", then, at step S607, the change amount deltaFAFi of the air/fuel ratio compensation coefficient FAF due to purge according to equation (4) above is derived.

Furthermore, at step S608 there is derivation of the present compensation value FAF as a value resulting from subtracting ½ averaged value of the change amount of the compensation coefficient FAF from the previous compensation value FAFi−1. This is then stored in the FAF memory 204 to end the process.

As was mentioned above, by the compensation of the air/fuel ratio compensation coefficient FAF stored in the FAF memory 204, there is execution of equation (2) in the fuel injection amount setting section 208 based on the compensated air/fuel ratio compensation coefficient FAF to then set the fuel injection amount TAU.

Figures 16A, 16B, 16C:
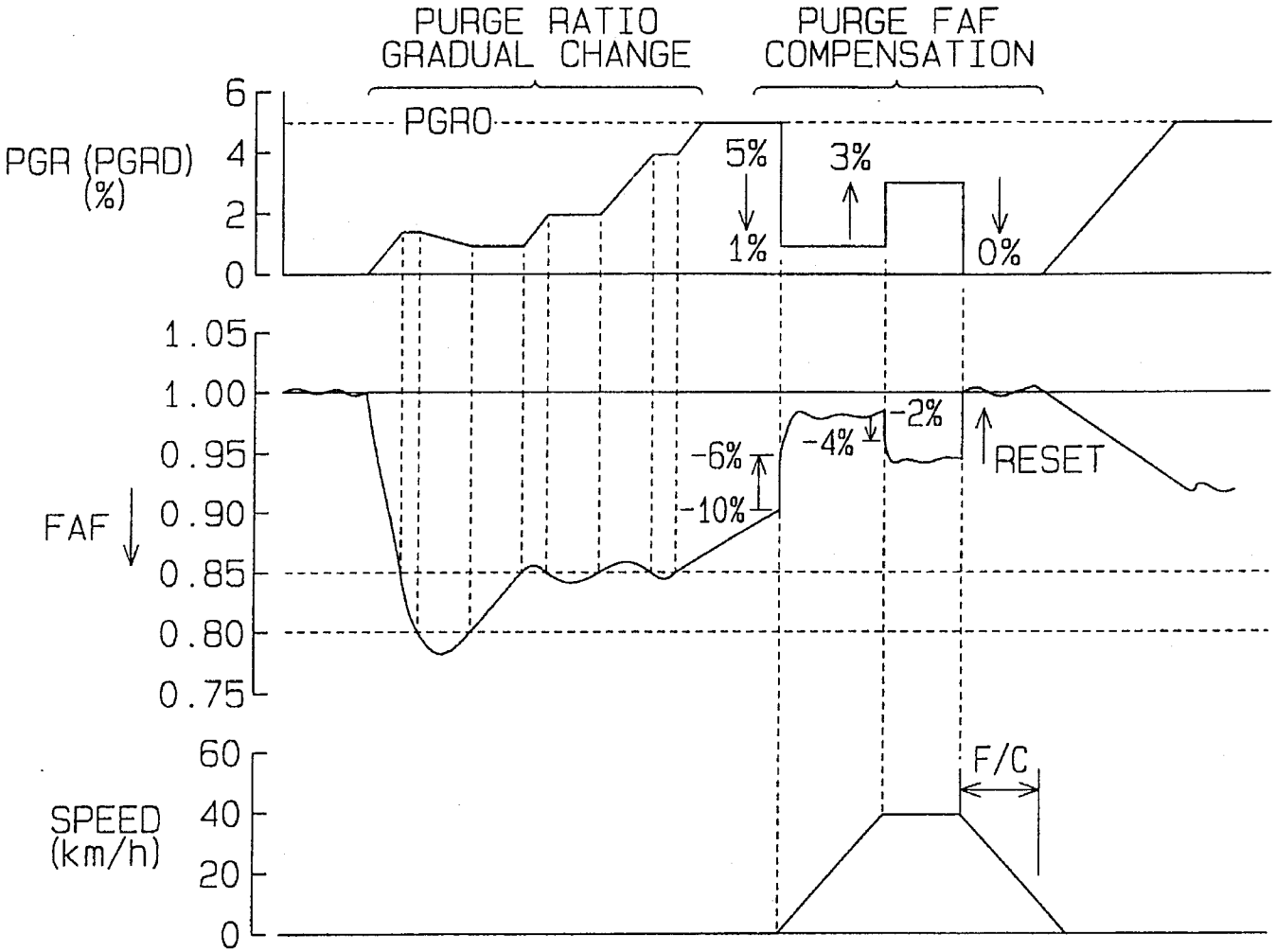
FIGS. 16A through 16C are time charts showing the purge ratio control conditions and purge FAF compensation state in the embodiment.

FIGS. 16A through 16C show the procedure for purge ratio control and purge FAF compensation based on the device in the present embodiment.

As is shown in FIGS. 16A through 16C, according to the device in the present embodiment, there is control of the purge ratio as described below as well as compensation of the purge FAF.

(1) With the start of purge, a major fluctuation of the air/fuel ratio compensation coefficient FAF toward the "rich" side. Thus, purge ratio gradual change control is started. Following the process shown in FIG. 13, gradual change control is carried out according to the procedure labeled as "purge ratio gradual change" in FIG. 16A in response to the deviation amount "|1−FAFAV|" each time of the air/fuel ratio compensation coefficient FAF. Incidentally, in the graph in FIG. 16B showing the air/fuel ratio compensation coefficient FAF, the value on the vertical axis "0.85" shows a deviation of 15% from the standard value "1.00" meaning no fuel amount correction. Likewise, the value on the vertical axis "0.80" shows a deviation of 20% from the standard value "1.00". As was mentioned already above, the running conditions at the start of purge are as follows:

(C1) it is during control of air/fuel ratio feedback (F/B);

(C2) air/fuel ratio learning is completed;

(C3) the cooling water temperature THW is 60° C. or higher; and (C4) there has been no fuel cut (F/C).

(2) Along with purge ratio gradual change control, when the purge ratio PRG presently reaches the target purge ratio PGRO, the purge ratio is determined each time according to the target purge ratio PGRO(5%) or the full open purge ratio PGRMX shown in FIG. 12.

(3) If it is assumed that there is acceleration of a vehicle mounted with engine 10 under the conditions just described as shown in FIG. 16C, along with an increase in the engine load, the full load purge ratio PGRMX declines to "1%" ("5%→1%" in FIG. 16A). As a result, in such a case, the full open purge ratio PGRMX ("1%") is set in the PGR memory 213 as the purge ratio PGR. The value of the full open purge ratio PGRMX at that time corresponds to the value "1.1" corresponding to Ne=3200 and PM=651 as shown in the full open purge ratio map in FIG. 12.

(4) If the purge ratio PGR changes to the extent that it exceeds the designated value as described above ("0.5%"), the purge FAF compensation section 218 is started and there is purge FAF compensation based on equations (4) and (5) above. In the present embodiment, after obtaining the change amount deltaFAFi of the air/fuel ratio compensation coefficient FAF due to purge by means of equation (4), there is ½ averaging of the compensation value based on equation (5). As a result, although the compensation coefficient FAF should actually be compensated from "−10%" to "–2%", the compensation is restricted to "–6%" ("–10%→–6%").

(5) In the following steps, during the period when there is no change in the purge ratio, the value of the compensation coefficient FAF changes along with the air/fuel ratio feedback control. In the present example, as is shown in FIG. 16B, there is shift to a value of "–2%" which is then maintained.

(6) Then, when acceleration of the vehicle stops and the state changes to the so-called steady running state, the load on the engine 10 decreases and the full open purge ratio PGRMX increases to "3%" ("1%→3%" in FIG. 16A). In this case as well, the full open purge ratio PGRMX ("3%") is set in the PGR memory 213 as the purge ratio PGR. The value of the full open purge ratio PGRMX at this time corresponds to the value "3.3" corresponding to Ne=2000 and PM=525 as shown in the full open purge ratio map in FIG. 12.

(7) With a change in the purge ratio PGR, the purge FAF compensation section 218 operates, and purge FAF compensation is carried out according to equations (4) and (5) above. In such a case, the air/fuel ratio compensation coefficient FAF is compensated from "–2%" to "–4%" ("–2%→–4%" in FIG. 16B).

(8) Then, if the vehicle starts deceleration from the steady running state so that the engine 10 goes to the fuel cut (F/C) state, the purge ratio control section 210 determines that state and clears the purge execution flag XPRG. In other words, purge is stopped when fuel cut has started so that there is reset of the air/fuel ratio compensation coefficient FAF to "1.0" via the processes in steps S609 and S610 in FIG. 15 by means of the purge FAF compensation section 218.

(9) If the fuel cut state is subsequently released, purge is started again and purge ratio gradual change control in the state described above is begun again in response to fluctuations toward the "rich" side of the air/fuel ratio compensation coefficient FAF.

As shown above, with the device in the present embodiment, there is compensation of the air/fuel ratio compensation coefficient FAF according to the amount of change in the purge ratio. Thus, compared with monitoring of the purge ratio itself, the errors of the purge solenoid valve 45 itself and the errors in purge flow calculation effectively cancel each other out and are absorbed. As a result, there is no need for an expensive control valve and extensive control logic for the purge solenoid valve 45, thus making it possible to obtain the desired appropriate air/fuel ratio.

Also, with the device in the present embodiment there is compensation of the compensation coefficient FAF with the change amount of the purge ratio as the object of monitoring. Thus, even in cases employing air/fuel ratio feedback control with the air/fuel ratio sensor 36 with its outstanding response, it is possible to accurately gain a grasp on fluctuations in the compensation coefficient FAF due to purge and to carry out compensation.

Also, with the device in the present embodiment there is compensation of the compensation coefficient FAF only when the change amount of the purge ratio is above a designated value. For this reason, in states where there is little change in the purge ratio (i.e., conditions where, although there is purge, the feedback control system is relatively stable) there is restriction of unnecessary compensation regarding the compensation coefficient FAF.

Furthermore, there is averaging of the change amount deltaFAFi of the air/fuel ratio compensation coefficient FAF according to the purge computed according to equation (4) mentioned above, and then compensation of the compensation coefficient FAF according to the amount of average value. As a result, along with restriction of unnecessary compensation regarding the compensation coefficient FAF, there is no negative effect on the convergence and stability of the air/fuel ratio feedback control system, achieving the purge FAF compensation.

With the device in the present embodiment, as is shown in the purge FAF compensation routine in FIG. 15, if the change amount of the purge ratio "|PRGi–1–PRGi" exceeds a determined value, there was execution of compensation of the air/fuel ratio compensation coefficient FAF. However, it is also possible to modify as shown in FIG. 17, for example:

If the change amount of the purge ratio of the air/fuel ratio compensation coefficient "deltaFAFi–1–deltaFAFi" exceeds a determined value, there is compensation of the compensation coefficient FAF.

Figure 17:
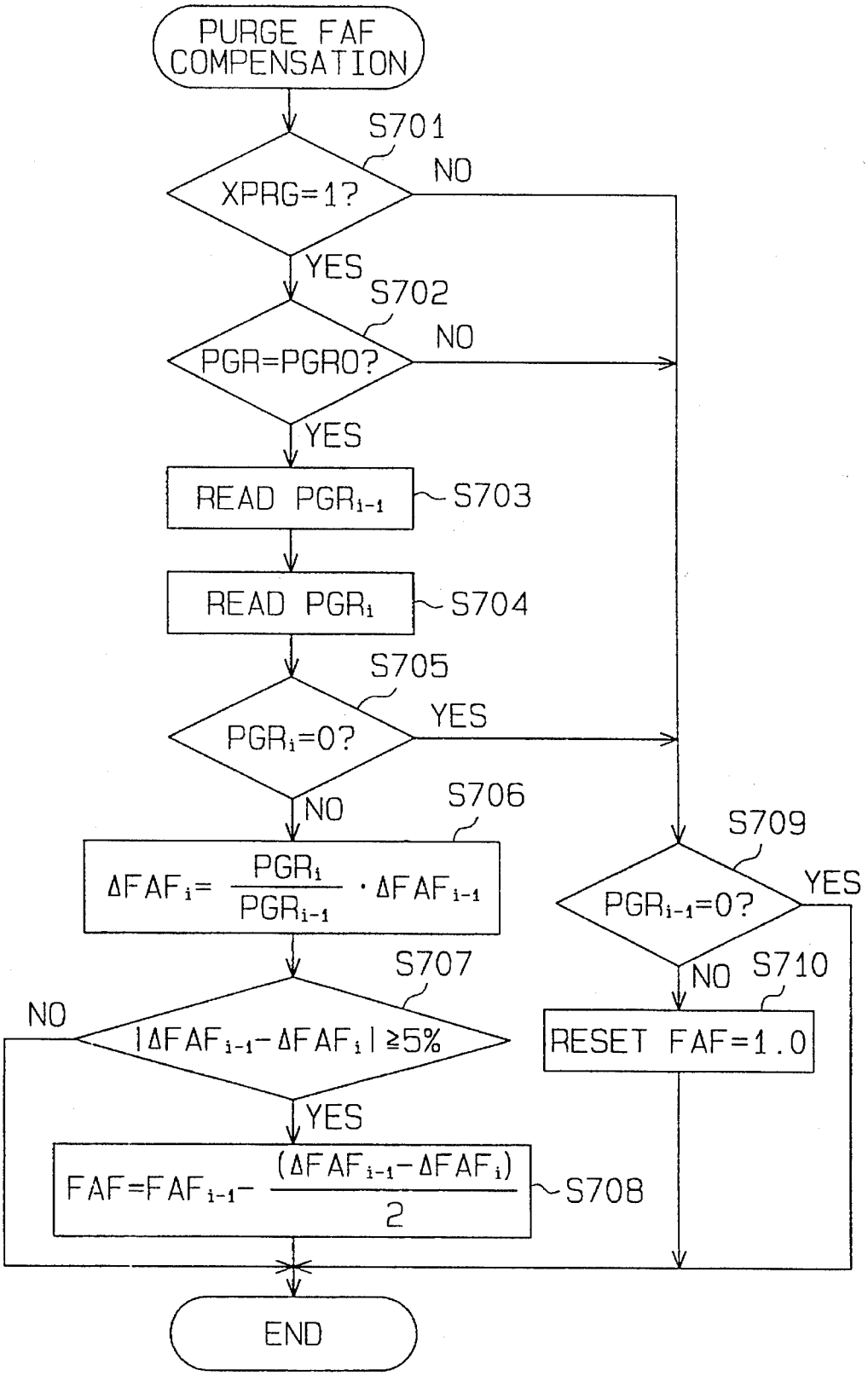
FIG. 17 is a flowchart showing the coefficient compensation process regarding another compensation method of the purge FAF compensation.

In other words, in the purge FAF compensation routine as shown in FIG. 17, at step S706 there is first computation of the change amount deltaFAFi of the air/fuel ratio compensation coefficient FAF by purge according to the equation (4). Then, at step S707 there is derivation of the change rate of the compensation coefficient "|deltaFAFi–1–deltaFAFi|" and it is determined whether the change amount is above the designated value (i.e., "5%") or not.

If the purge ratio change amount "|deltaFAFi–1–deltaFAFi|" is less than "5%", the change of the air/fuel ratio compensation coefficient FAF due to purge is small and it is determined that there is no need to carry out compensation of the coefficient FAF so that processing ends at that point.

On the other hand, if the purge ratio change amount "|deltaFAFi–1–deltaFAFi|" is more than "5%", there is execution of the equation (5) at step S708, and the compensation value FAF obtained is stored in the FAF memory 204 to end the process.

The other processes in the purge FAF compensation routine are based on the purge FAF compensation routine in FIG. 15 as described above.

Thus, even in the case of a structure where there is compensation of the compensation coefficient FAF if the change amount of the air/fuel ratio compensation coefficient according to changes in the purge ratio "|deltaFAFi–1–deltaFAFi|" is above a determined value, it is possible to realize substantially the same purge FAF compensation processing as the device in the embodiment.

Also, regarding the purge FAF compensation processing, the change amount deltaFAF of the air/fuel ratio compensation coefficient FAF due to purge is averaged as follows:

$$(\text{deltaFAFi–1–deltaFAFi})/2.$$

The frequency of averaging and whether the processing is carried out is arbitrary. For example, if there is no averaging and compensation of the air/fuel ratio compensation coefficient FAF according to the following equation:

$$FAF=FAFi-1-\text{delta}FAFi \quad (5).$$

Although there is a possibility of a negative effect on convergence and stability as a feedback control system, there is an increase in the control speed itself.

Also, with the device in the embodiment, the full open purge ratio PGRMX map 211 was the two-dimensional map determined by the engine rotational speed Ne and the intake air pressure PM. However, the selection of the load amount is optional. In other words, it is naturally possible to make use of values such as the intake air volume or the throttle opening degree instead of the intake air pressure PM. Even when using other such load amount, it is possible to obtain substantially the same full open purge ratio PGRMX as above.

Also, with the device in the embodiment described above, in case of air/fuel ratio control, regarding the target air/fuel ratio lambda TG in the time from when the air/fuel ratio sensor 36 becomes activated until the three-way catalyst 38 reaches an activated state, this is set according to the cooling water temperature TWH (FIG. 5). However, regarding the target air/fuel ratio lambda TG prior to activation of the catalyst 38, for example, it is possible to set to a specific value such as "1.2". In the sense of bringing the target air/fuel ratio at that time to lean air/fuel ratio (17 to 18), even if there is setting as fixed values, it is possible to realize basically the same air/fuel ratio control.

Also, with the device in the embodiment described above, concerning air/fuel ratio control, there is setting of the target air/fuel ratio lambda TG based on the dither control employing the $O_2$ sensor downstream the three-way catalyst 38 has reached an activated state (FIGS. 8A through 9B). However, with the air/fuel ratio control device in the present invention, it is not required to install and employ the $O_2$ sensor 37. In other words, regarding the air/fuel ratio feedback control system, it is enough to include a system for controlling the operation amount of the fuel injection valve 16 so that the air/fuel ratio of the supplied air-fuel mixture reaches the target value based on output from the air/fuel ratio sensor 36. In this case, the setting method of the target air/fuel ratio lambda TG is not limited to the dither control described above.

With the device in the embodiment described above, there was simultaneous employment of learning control of the air/fuel ratio to increase air/fuel ratio control accuracy. Basically, however, if there is the structure to compensate the compensation coefficient FAF regarding feedback control in response to the change amount of the purge flow ratio to the engine air intake amount, it is possible to obtain the desired appropriate air/fuel ratio.

As was explained above, with the present invention, there is compensation of the compensation coefficient relating to air/fuel ratio feedback control according to the change amount of the purge ratio. Thus, compared with cases where there is monitoring of the purge flow volume itself, it is easy to absorb errors of the purge solenoid valve itself and errors in purge flow calculation. As a result, there is no need for an expensive control valve and extensive control logic for the purge solenoid valve, thus making it possible to obtain the desired appropriate air/fuel ratio.

Also, with the present invention, there is compensation of the compensation coefficient with the change amount of the purge ratio as the object of monitoring. Thus, even in cases employing a linear air/fuel ratio sensor as the air/fuel ratio sensor, it is possible to accurately gain a grasp on fluctuations in the compensation coefficient due to purge and to carry out compensation. Moreover, by using the linear air/fuel ratio sensor, there is also an improvement in the control accuracy of the air/fuel ratio feedback control.

Likewise, by obtaining the proper air/fuel ratio, it is possible to improve emissions and drivability.

What is claimed is:

1. An air/fuel ratio control apparatus for internal combustion engines comprising:

a fuel injection valve for injecting fuel supplied from a fuel tank into an engine;

a canister storing therein fuel vapor generated in the fuel tank;

a purge passage for leading the fuel vapor stored in the canister to an air intake portion of the engine;

a flow control valve disposed in the purge passage for controlling a flow amount of the fuel vapor led through the purge passage in accordance with an intake air amount of the engine;

an air/fuel ratio sensor disposed in an exhaust portion of the engine for detecting, from an exhaust gas of the engine, an air/fuel ratio of mixture of air and fuel including the fuel vapor supplied to the engine;

feedback control means for controlling, in accordance with the detected air/fuel ratio, an amount of the fuel injected from the fuel injection valve thereby to control the air/fuel ratio of the mixture to a target value; and compensation means for compensating, by a change amount of ratio of the flow amount of the fuel vapor relative to the intake air amount, a compensation coefficient used in the feedback control means.

2. An air/fuel ratio control apparatus according to claim 1, wherein:

said compensation means compensates the compensation coefficient when the change amount of the ratio of the flow amount exceeds a predetermined value.

3. An air/fuel ratio control apparatus according to claim 1, wherein:

said compensation means compensates the compensation coefficient when a change amount of the compensation coefficient corresponding to a change in the ratio of the flow amount exceeds a predetermined value.

4. An air/fuel ratio control apparatus according to claim 3, wherein:

said compensation means determines a present value of a compensation value ΔFAFi as ΔFAFi=(PGRi/PGRi−1)×Δ FAFi−1, with i, PGRi−1, PGRi and ΔFAFi−1 being defined as a number of compensations, a value of the ratio of the fuel vapor flow amount at the time of a previous compensation, a value of the ratio of the fuel flow amount for a current compensation and a previous value of the change amount of the compensation coefficient corresponding to the change in the ratio of the flow amount, respectively.

5. An air/fuel ratio control apparatus according to claim 4, wherein:

said compensation means compensates the correction coefficient after averaging the determined compensation value ΔFAFi.

6. An air/fuel ratio control apparatus according to claim 5, wherein:

said compensation means determines a current value of the compensation coefficient FAF as FAF=FAFi−1−(ΔFAFi−1 −ΔFAFi)/2, with ΔFAFi−1 being defined as the compensation coefficient at the time of a previous compensation.

* * * * *